US009945180B2

(12) United States Patent
Hartke et al.

(10) Patent No.: US 9,945,180 B2
(45) Date of Patent: Apr. 17, 2018

(54) DRILLING MACHINE AND METHOD

(71) Applicant: Vermeer Manufacturing Company, Pella, IA (US)

(72) Inventors: Louis C. Hartke, Otley, IA (US); David J. Hackman, Pella, IA (US); Daniel L. Gustafson, Pella, IA (US); Chad A. Bartels, Pleasantville, IA (US); Orin L. Miller, Pella, IA (US); John W. Philbrook, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 526 days.

(21) Appl. No.: 14/168,236

(22) Filed: Jan. 30, 2014

(65) Prior Publication Data

US 2014/0144707 A1 May 29, 2014

Related U.S. Application Data

(63) Continuation of application No. 13/006,665, filed on Jan. 14, 2011, now abandoned.

(60) Provisional application No. 61/295,535, filed on Jan. 15, 2010.

(51) Int. Cl.

| | |
|---|---|
| ***E21B 19/16*** | (2006.01) |
| ***E21B 7/00*** | (2006.01) |
| ***E21B 7/02*** | (2006.01) |
| ***E21B 15/00*** | (2006.01) |
| ***E21B 15/04*** | (2006.01) |
| ***E21B 7/04*** | (2006.01) |
| ***E21B 19/086*** | (2006.01) |
| ***E21B 19/15*** | (2006.01) |
| ***E21B 19/20*** | (2006.01) |

(52) U.S. Cl.

CPC ..... *E21B 7/00* (2013.01); *E21B 7/02* (2013.01); *E21B 7/046* (2013.01); *E21B 15/006* (2013.01); *E21B 15/04* (2013.01); *E21B 19/086* (2013.01); *E21B 19/15* (2013.01); *E21B 19/166* (2013.01); *E21B 19/20* (2013.01)

(58) Field of Classification Search

CPC ..... E21B 19/166

See application file for complete search history.

(56) References Cited

U.S. PATENT DOCUMENTS

| | | | | |
|---|---|---|---|---|
| 4,972,741 | A * | 11/1990 | Sibille | B25B 23/14 81/57.16 |
| 6,752,043 | B2 | 6/2004 | Carlson | |
| 6,808,029 | B2 | 10/2004 | De Lille | |
| 6,814,164 | B2 | 11/2004 | Mills et al. | |
| 6,845,825 | B2 | 1/2005 | Bischel et al. | |
| 6,860,337 | B1 | 3/2005 | Orr et al. | |

(Continued)

FOREIGN PATENT DOCUMENTS

WO 2009/080876 A1 7/2009

OTHER PUBLICATIONS

Extended European Search Report (EP 14 181 496.2) dated Jan. 29, 2015 (5 pages).

(Continued)

*Primary Examiner* — Giovanna C. Wright

(74) *Attorney, Agent, or Firm* — Merchant & Gould, P.C.

(57) ABSTRACT

The present disclosure provides a machine capable of drilling into the ground at a wide range of angles relative to the ground surface. The present disclosure also provides novel drilling methods.

19 Claims, 32 Drawing Sheets

(56) References Cited

U.S. PATENT DOCUMENTS

| | | | |
|---|---|---|---|
| 6,880,430 | B2 | 4/2005 | Carlson |
| 6,896,072 | B2 | 5/2005 | MacDonald |
| 6,969,222 | B1 | 11/2005 | Koch |
| 7,240,742 | B2 | 7/2007 | Sewell et al. |
| 7,243,753 | B2 | 7/2007 | Barthomeuf et al. |
| 7,267,182 | B2 | 9/2007 | Saha |
| 7,281,587 | B2 | 10/2007 | Haugen |
| 7,313,986 | B2 | 1/2008 | West et al. |
| 7,318,491 | B2 | 1/2008 | Riel |
| 7,350,593 | B1 | 4/2008 | Brookover |
| 7,467,670 | B2 | 12/2008 | Hartke et al. |
| 7,600,584 | B2 | 10/2009 | Sewell et al. |
| 7,617,887 | B2 | 11/2009 | Piipponen |
| 7,694,751 | B2 | 4/2010 | Hartke |
| 7,793,719 | B2 | 9/2010 | Snider et al. |
| 8,251,151 | B2 | 8/2012 | Haugen |
| 2003/0056986 | A1 | 3/2003 | De Lille |
| 2003/0056988 | A1 | 3/2003 | Smith |
| 2004/0129455 | A1 | 7/2004 | Koch et al. |
| 2005/0067168 | A1 | 3/2005 | Baird |
| 2007/0119623 | A1 | 5/2007 | Sewell et al. |
| 2008/0047749 | A1* | 2/2008 | Koithan ..... B23P 19/061 175/40 |
| 2008/0185185 | A1 | 8/2008 | Mitchell et al. |
| 2009/0014215 | A1 | 1/2009 | Hartke |
| 2009/0056931 | A1 | 3/2009 | Kruse et al. |
| 2009/0151934 | A1* | 6/2009 | Heidecke ..... E21B 3/02 166/250.01 |
| 2009/0277308 | A1 | 11/2009 | Light et al. |
| 2009/0283324 | A1 | 11/2009 | Konduc et al. |
| 2009/0314137 | A1 | 12/2009 | Perez |
| 2010/0230115 | A1 | 9/2010 | Belik |

OTHER PUBLICATIONS

Supplementary European Search Report (EP 11 73 3436) dated Mar. 2, 2015 (5 pages).

* cited by examiner

DRILLING MACHINE AND METHOD

RELATED APPLICATIONS

This application is a continuation of U.S. application Ser. No. 13/006,665, filed Jan. 14, 2011, which claims priority to U.S. Provisional Application No. 61/295,535 filed on Jan. 15, 2010, and which applications are incorporated herein by reference. To the extent appropriate, a claim of priority is made to each of the above disclosed applications.

TECHNICAL FIELD

The present disclosure relates to drilling machines and methods for underground drilling.

BACKGROUND

Horizontal directional drill machines configured to drill into the ground at a relatively low angle (e.g., between ten to thirty degrees relative to the ground surface) are known. In addition, machines configured to drill vertically relative to the ground surface are also known.

SUMMARY

One aspect of the present disclosure relates to machines capable of drilling into the ground at a wide range of angles relative to the ground surface. Other aspects of the present disclosure relate to: a control system for ensuring that drill rods of a drill string are securely threaded together; a control system that can be used to vary rotational speed to optimize drilling efficiency; a stabilization assembly to stabilize the machine during drilling operations; a drill angle adjustment assembly that orients a drill rod driving assembly at a variety of angles including angles typically used in both traditional horizontal drilling as well as angles typically used in geothermal drilling; hold down assemblies for biasing drill rods in a rod box towards a drill rod exit; a vise assembly that is configured to move into and out of alignment with a drill string; and load arms with fingers that securely grip drill rods. These and other aspects of the present disclosure can be used alone or in combination with each other.

DETAILED DESCRIPTION

Figure 1:
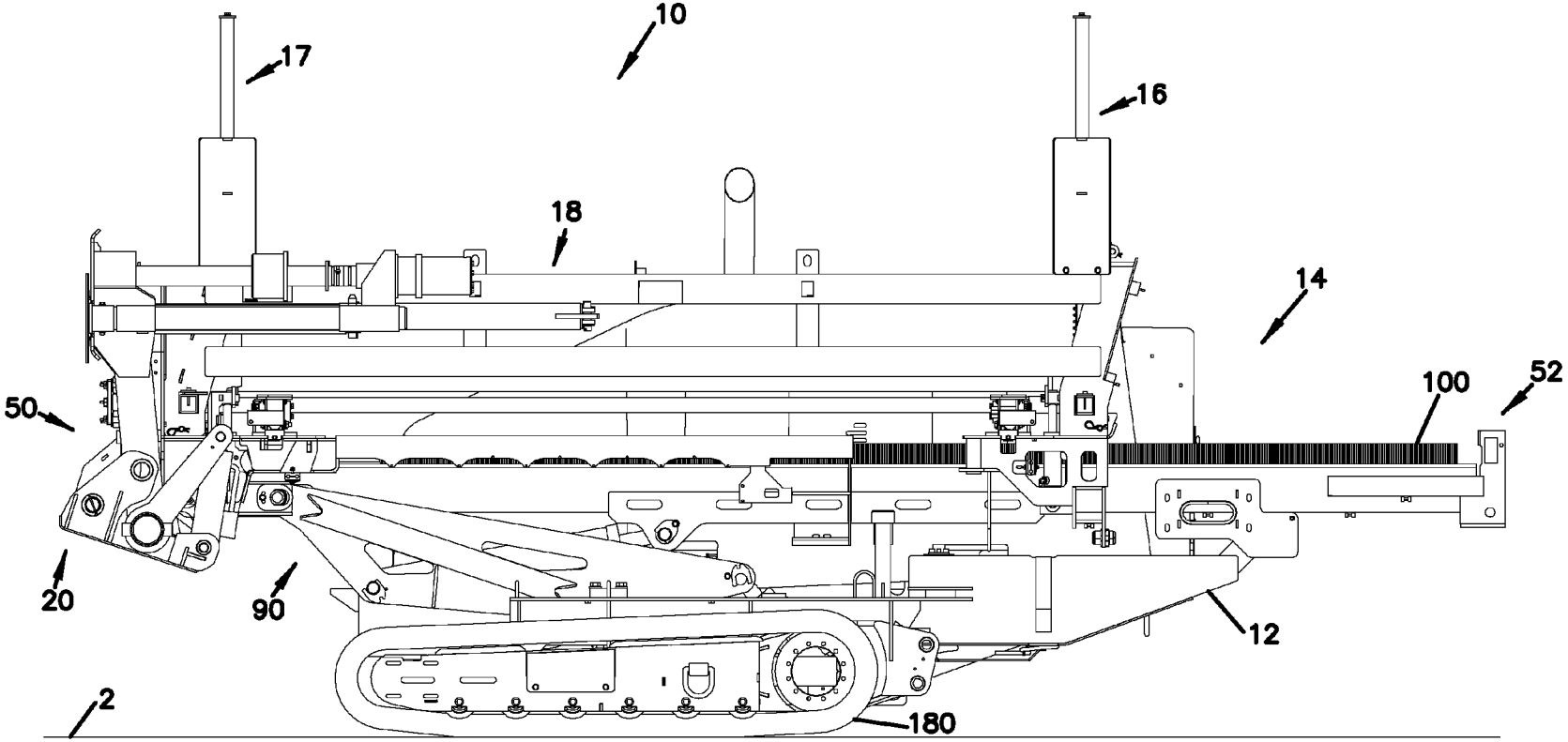
FIG. 1 is a side view of a ground drilling machine according to the present disclosure shown in a transport orientation.
Figure 2:
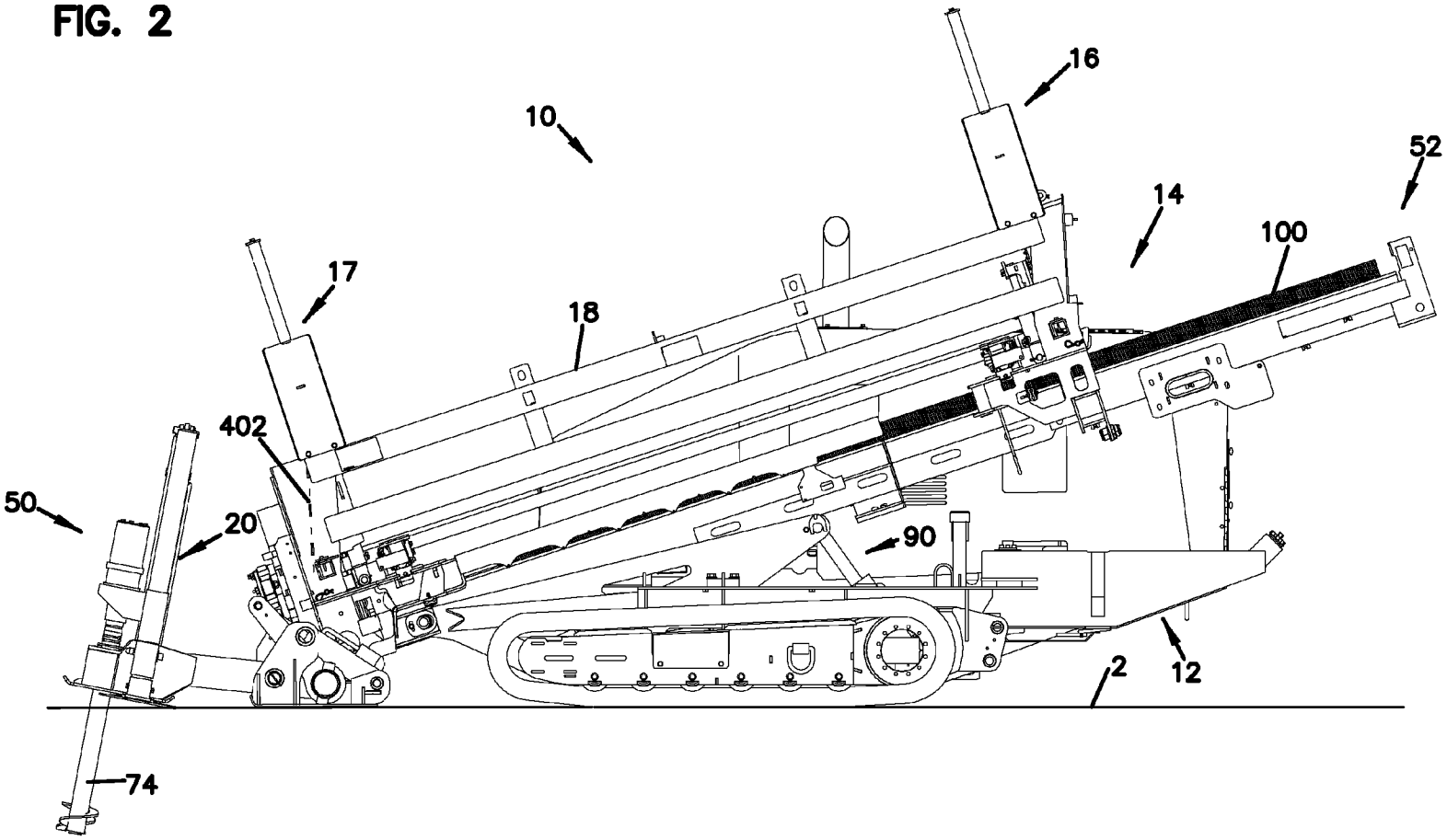
FIG. 2 is a side view of the ground drilling machine of FIG. 1 shown in a horizontal drilling orientation.
Figure 3:
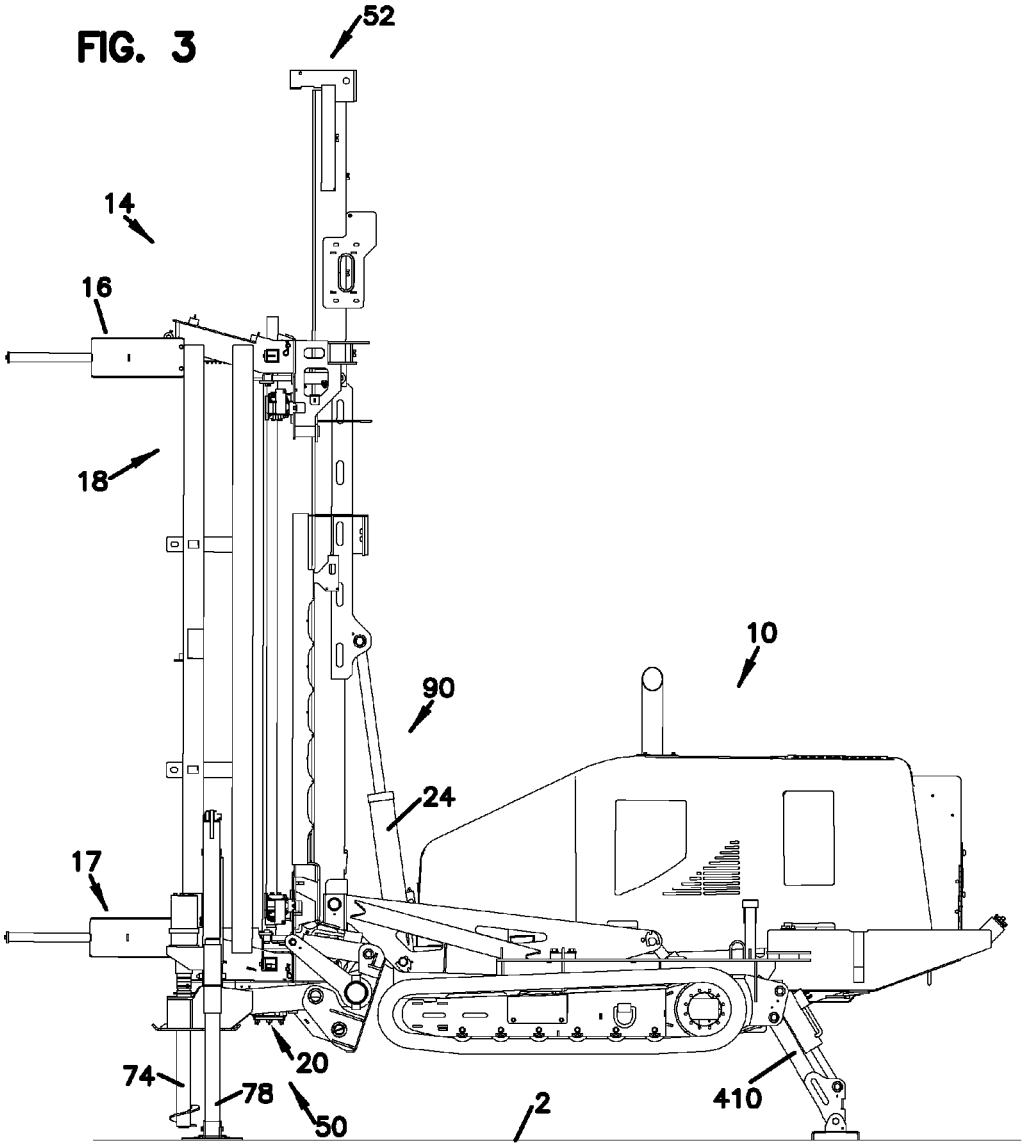
FIG. 3 is a side view of the ground drilling machine of FIG. 1 shown in a geothermal drilling orientation.
Figure 4:
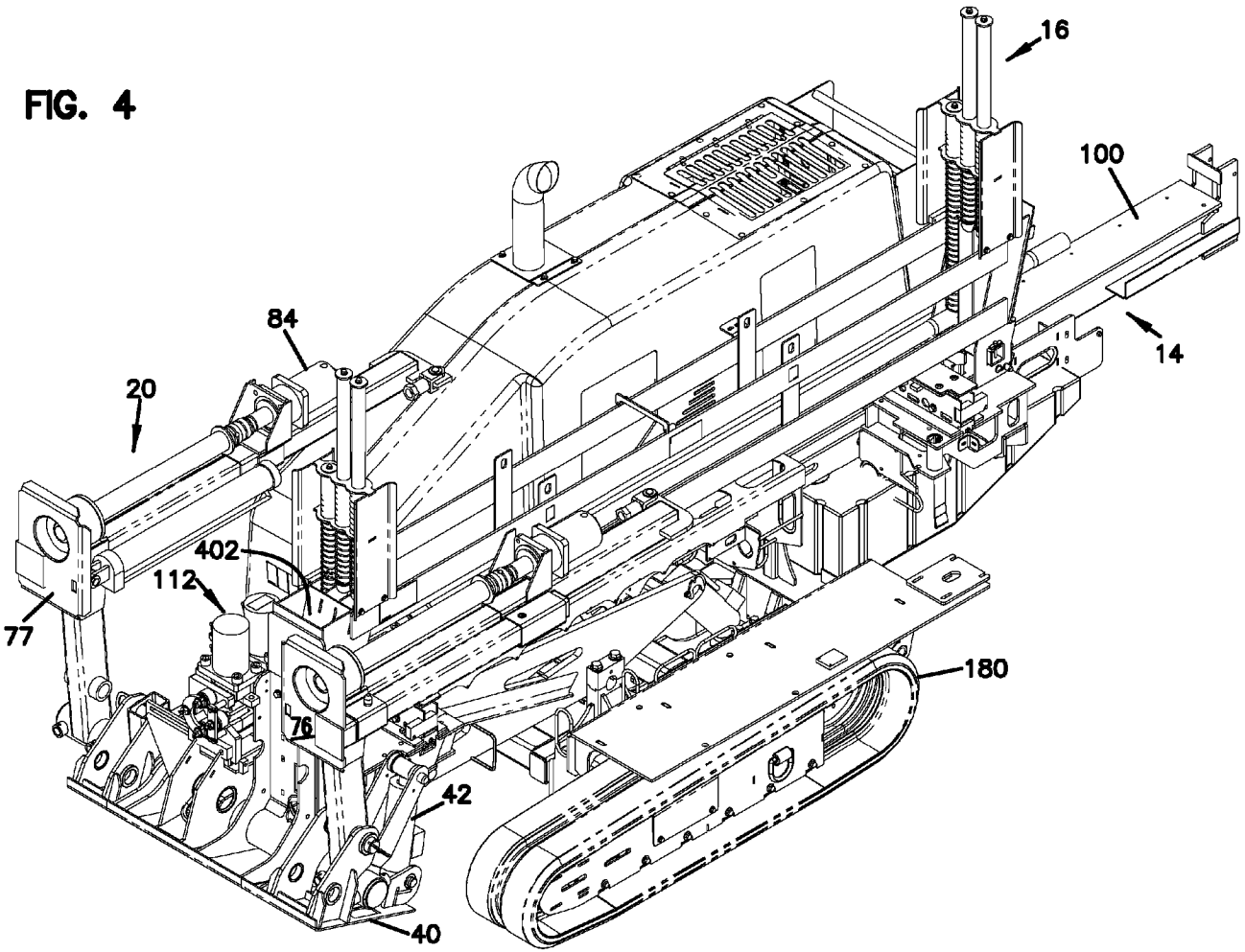
FIG. 4 is a perspective view of the ground drilling machine of FIG. 1 shown in a transport orientation.
Figure 5:
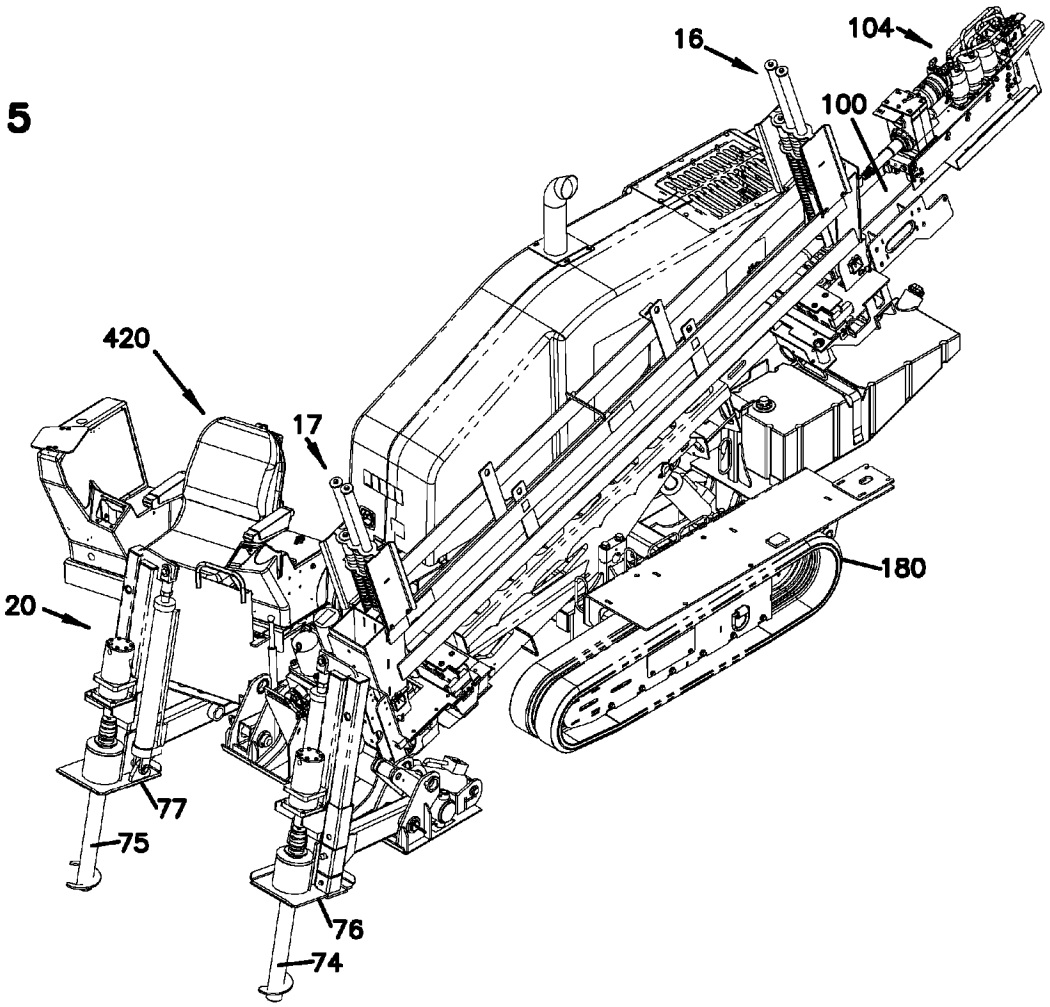
FIG. 5 is a perspective view of the ground drilling machine of FIG. 1 shown in a horizontal drilling orientation.
Figure 6:
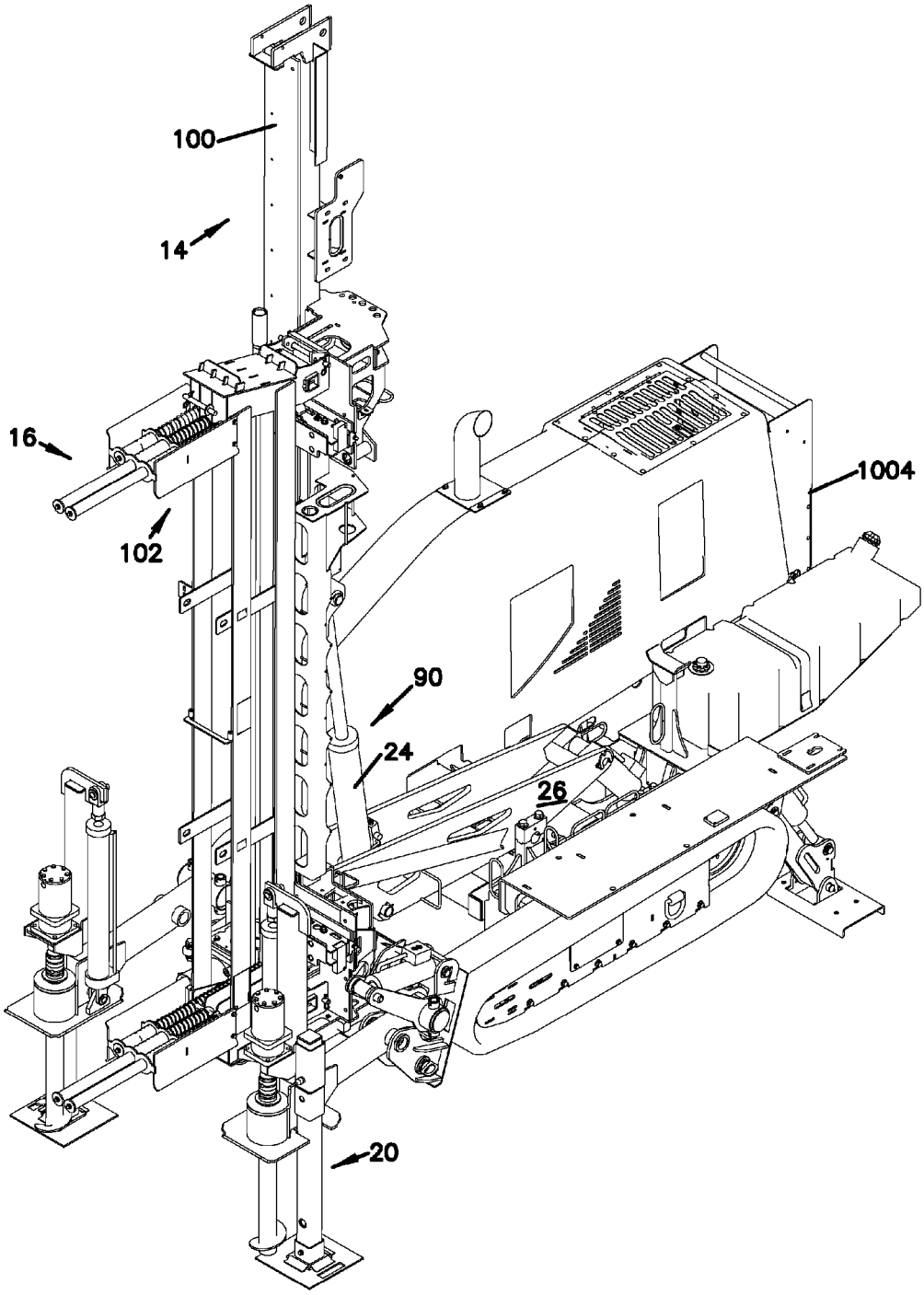
FIG. 6 is a perspective view of the ground drilling machine of FIG. 1 shown in a geothermal drilling orientation.

An aspect of the present disclosure relates to machines capable of drilling into the ground at a wide range of angles relative to the ground surface. Referring to FIGS. 1-6, an embodiment of a ground drilling machine according to the present disclosure is shown in several different orientations. Views of the ground drilling machine 10 in a transport orientation are shown in FIGS. 1 and 4. Views of the ground drilling machine 10 in a horizontal drilling orientation are shown in FIGS. 2 and 5. Views of the ground drilling machine in a geothermal drilling orientation are shown in FIGS. 3 and 6.

The transport orientation is used herein to refer to an orientation that corresponds to an orientation that the drilling machine is typically in when the machine is transported and/or driven to or from the drill location. Referring to FIGS. 1 and 4, in the depicted embodiment, a rack and a rod box are generally horizontal in the transport orientation with a drill stabilization assembly pivoted upwardly towards the chassis of the drilling machine. It should be appreciated that the machine of the depicted embodiment can also be transported and/or driven from one location to another location in other orientations as well.

The horizontal drilling orientation is used herein to refer to an orientation that corresponds to an orientation that the drilling machine is typically in when the machine is positioned for horizontal directional drilling. Referring to FIGS. 2 and 5, in the depicted embodiment, the rack and the rod box are generally at an angle relative to the ground that is greater than zero and less than forty-five degrees (more typically between ten to thirty degrees), and the drill stabilization assembly is pivoted downwards away from the chassis so that ground anchors are secured into the ground. It should be appreciated that many different drilling applications can be performed with the drilling machine 10 in the horizontal drilling orientation including typical horizontal drilling applications as well as geothermal drilling applications where drill holes at least start at less than a forty-five degree angle from the ground surface.

The geothermal drilling orientation is used herein to refer to an orientation that corresponds to an orientation in which the drilling machine is typically in when it is configured for a geothermal application. Referring to FIGS. 3 and 6, in the depicted embodiment, the rack 100 and the rod box 18 are at an angle relative to the ground that is between forty-five to ninety degrees, the drill stabilization assembly 20 is pivoted upward towards the chassis 12, and the stabilization legs 78, 79 are extended such that they are engaged with the ground. It should be appreciated that many different drilling applications can be performed with the drilling machine 10 in the geothermal drilling orientation including, for example, well drilling.

Referring generally to FIGS. 1-6, the ground drilling machine 10 is described in greater detail. In the depicted embodiment, the ground drilling machine 10 includes a chassis 12 supported on a pair of tracks 180 that rotate to move the ground drilling machine 10, a drill rod drive assembly 14 supported on the chassis 12 for driving a drill string into the ground and retracting the drill string from the ground, a rod loading assembly 102 for delivering drill rods to and from the drill rod drive assembly 14 to buildup and disassemble a drill string 200, a vise assembly 112 to facilitate connecting and disconnecting drill rods 201 from the drill string 200, a drill angle adjustment assembly 90 for raising and lowering the drill rod drive assembly 14 to the desired orientation, a drill stabilization assembly 20 for stabilizing the ground drilling machine 10 during drilling operations, and a control system 150 for controlling particular drill operations.

In the depicted embodiment the drill angle adjustment assembly 90 is configured to move the drill rod drive assembly 14 from the transport orientation shown in FIGS. 1 and 4 to a desired drilling orientation. As discussed above, the desired drilling orientation can be an angle corresponding to traditional low angle direction drilling commonly referred to as horizontal direction drilling (HHD) shown in FIGS. 2 and 5, or the desired drilling orientation can be an angle corresponding to higher angle drilling typical of a geothermal or well drilling application shown in FIGS. 3 and 6.

Referring generally to FIGS. 1-9, the drill angle adjustment assembly 90 is described in greater detail. In the depicted embodiment the drill angle adjustment assembly 90 is configured to lift the down hole end 50 of the drill rod drive assembly 14 relative to the ground 2 as well as tilt the drill rod drive assembly 14 relative to the ground 2. In the depicted embodiment the lifting motion and tilting motion are independent. For example, the drill angle adjustment assembly 90 can tilt the drill rod drive assembly 14 with or without lifting the drill rod drive assembly 14. In addition, the tilting motion and the lifting motion can be simultaneous or in sequence. The drill angle adjustment assembly 90 is configured so that the down hole end 50 of the drill rod drive assembly 14 is positioned near the ground (e.g., less than four feet from the ground or more preferably less than three feet from the ground) in the horizontal drilling orientation.

Figure 7:
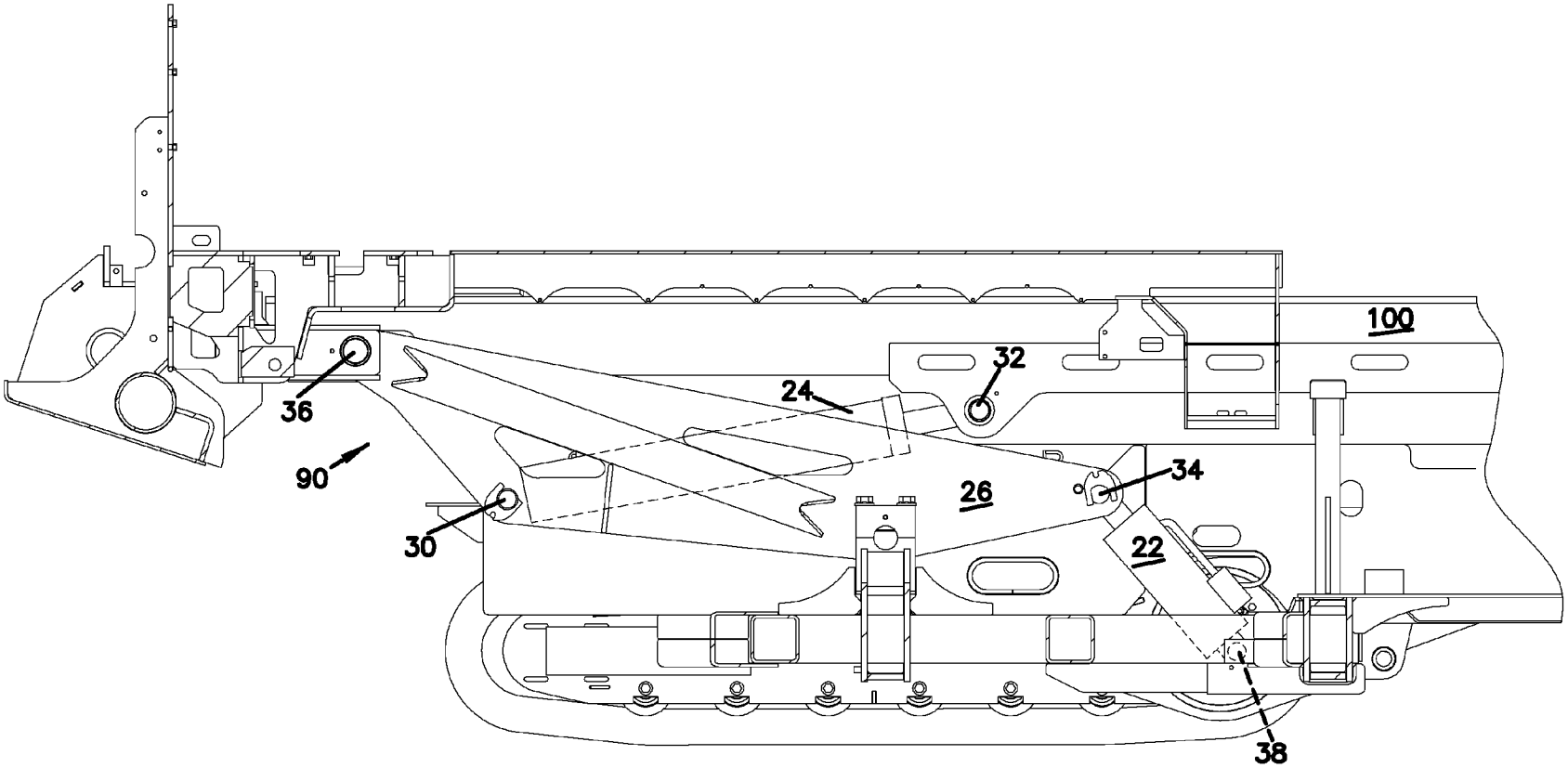
FIG. 7 is a partial cross-sectional view of a lift linkage of the ground drilling machine of FIG. 1 in a transport orientation with structure removed for clarity.
Figure 8:
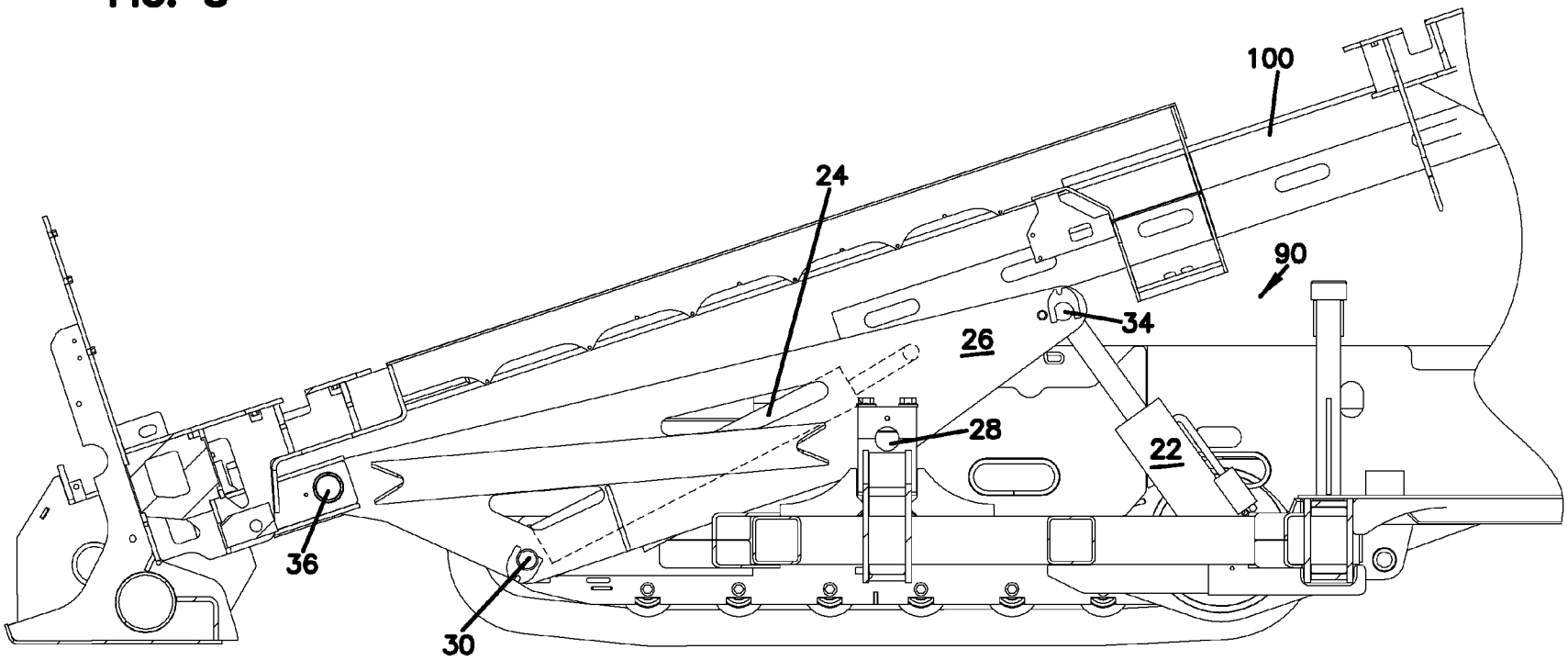
FIG. 8 is a partial cross-sectional view of the lift linkage of FIG. 7 in a horizontal drilling orientation.
Figure 9:
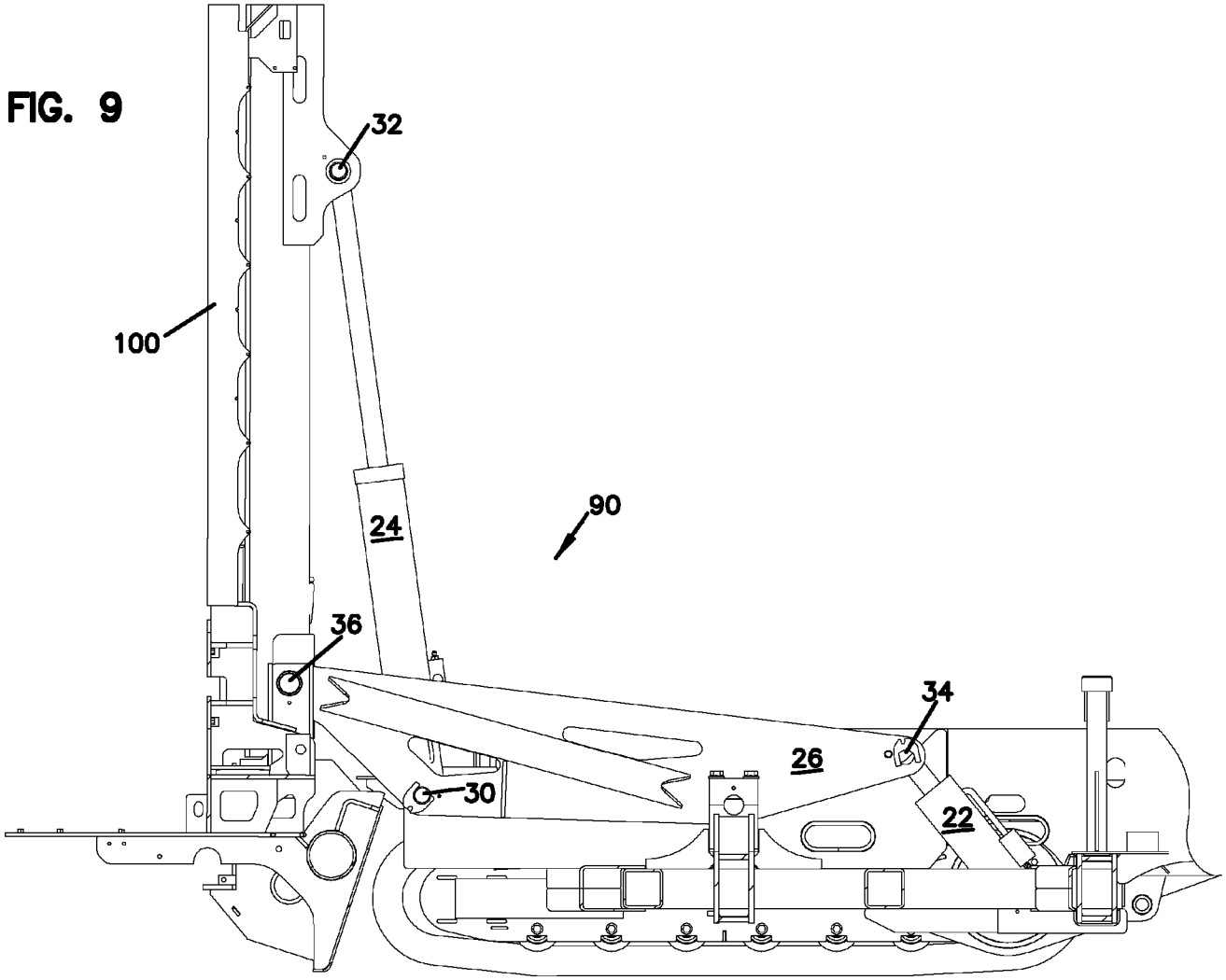
FIG. 9 is a partial cross-sectional view of the lift linkage of FIG. 5 in a geothermal drilling orientation.

Referring more particularly to FIGS. 7-9, the drill angle adjustment assembly 90 of the depicted embodiment includes a rocker link 26 pivotally connected to the chassis 12 at a rocker link chassis connection 28. The rocker link includes a first end portion located down hole of the rocker link chassis connection 28, and a second end portion located up hole of the rocker link chassis connection 28. The drill angle adjustment assembly 90 includes a tilt cylinder 22 with a first end pivotally connected to the second end portion of the rocker link 26 at a rocker link tilt cylinder connection 34, and a second end pivotally connected to the chassis 12 at a tilt cylinder chassis connection 38. In the depicted embodiment, the first portion of the rocker link down hole of the rocker link chassis connection 28 is pivotally connected to a down hole end of the drill rod drive assembly 14 at a rocker link drill rod drive assembly connection 36. In the depicted embodiment, the drill angle adjustment assembly 90 includes a lift cylinder 24 with a first end pivotally connected to the rocker link 26 at a lift cylinder rocker link connection 30 located between the rocker link drill rod drive assembly connection 36 and the rocker link chassis connection 28. The lift cylinder 24 includes a second end connected to the drill rod driving assembly 14 at a lift cylinder drill rod driving assembly connection 32 located up hole of the rocker link drill rod driving assembly connection 36. It should be appreciated that many alternative configurations and arrangements are also possible.

In the depicted embodiment the drill angle adjustment assembly 90 is configured such that extending or retracting the rocker tilt cylinder 22 raises and lowers a down hole end of the drill rod driving assembly, and extending the lift cylinder 24 is capable of changing the orientation of the drill rod driving assembly from a substantially horizontal orientation to a substantially vertical orientation. In the depicted embodiment the rocker link drill rod driving assembly connection 36 is located at a down hole end 50 of the drill rod driving assembly 14, the lift cylinder rocker link connection 30 is located between the rocker link drill rod driving assembly connection 36 and the rocker link chassis connection 28, and the rocker link chassis connection 28 is between the lift cylinder rocker link connection 30 and the rocker link tilt cylinder connection 34. In the depicted embodiment the rocker link chassis connection 28 is not aligned (i.e., offset from) the lift cylinder rocker link connection 30 and the rocker link tilt cylinder connection 34. In the depicted embodiment the distance between the rocker link chassis connection and the rocker link drill rod driving assembly connection is between 45 inches and 50 inches, and the distance between the rocker link chassis connection and the rocker link lift cylinder connection is between 30 inches and 35 inches. In the depicted embodiment the rocker link drill rod drive assembly connection 36 (i.e., the point upon which the drill rod drive assembly pivots) is located back from the down hole end 50 of the drill rod drive assembly a distance that is between 25 inches and 30 inches. It should be appreciated that many alternative configurations and arrangements are also possible.

One aspect of the present disclosure relates to a machine having the ability to raise and lower—relative to the chassis and the ground—a pivot point about where the rack pivots to move between different positions (i.e., transport, horizontal drilling, and geothermal). In the depicted embodiment the drill machine is oriented by pivoting a rack of a drill rod driving assembly about a pivot point 36, and raising the pivot point 36. As discussed above, in the depicted embodiment pivoting the rack 100 includes actuating a lift cylinder 24 connected between the rack 100 and a rocker link 26, and raising the pivot 36 including actuating a tilt cylinder 22 connected between the rocker link 26 and a chassis 12 of a drilling machine. As discussed above, the pivoting and raising can occur simultaneously or can occur sequentially.

Referring generally to FIGS. 1-6 and 10-12, the drill stabilization assembly 20 is described in greater detail. In the depicted embodiment the drilling method can include orienting a drill rod drive assembly 14 to a drilling angle relative to the ground surface 2; orienting a stabilization element at a desired angle relative to the ground surface; and extending the stabilization element towards the ground surface. In the depicted embodiment orienting the stabilization element at a desired angle relative to the ground surface 2 includes first orienting a drill rod drive assembly 14 to a drilling angle relative to the ground surface and then orienting the stabilization element at between a horizontal (zero) to a vertical (ninety) angle relative to the ground surface (e.g., 30 degrees, 80 degrees, etc.).

In the depicted embodiment the drill stabilization assembly 20 is configured to provide stabilization to the ground drilling machine 10 for drilling at a wide range of angles. The drill stabilization assembly 20 includes a stabilization subassembly 170. In the depicted embodiment, the stabilization subassembly 170 includes a pair of stabilization legs 78, 79 and a pair of ground anchors 74, 75. The pair of stabilization legs 78, 79 and the pair of ground anchors 74, 75 are configured to pivot about axis 62 relative to the drill rod drive assembly 14 upwardly to a retracted position (see FIGS. 1, 3, 4, and 6) and downwardly to an extended position (see FIGS. 2 and 5). In the depicted embodiment, the drilling machine is supported on track 180 with the anchors extending when the drilling machine is in a horizontal drilling orientation (see FIG. 2). In the depicted embodiment, the drilling machine is supported on legs (the tracks 180 are elevated from the ground surface) when the drilling machine is in a geothermal drilling orientation (see FIG. 3). In the depicted embodiment, the drilling machine is supported on four legs in the geothermal orientation (i.e., two retractable rear legs 410 and two retractable front legs 78, 79).

Figure 10:
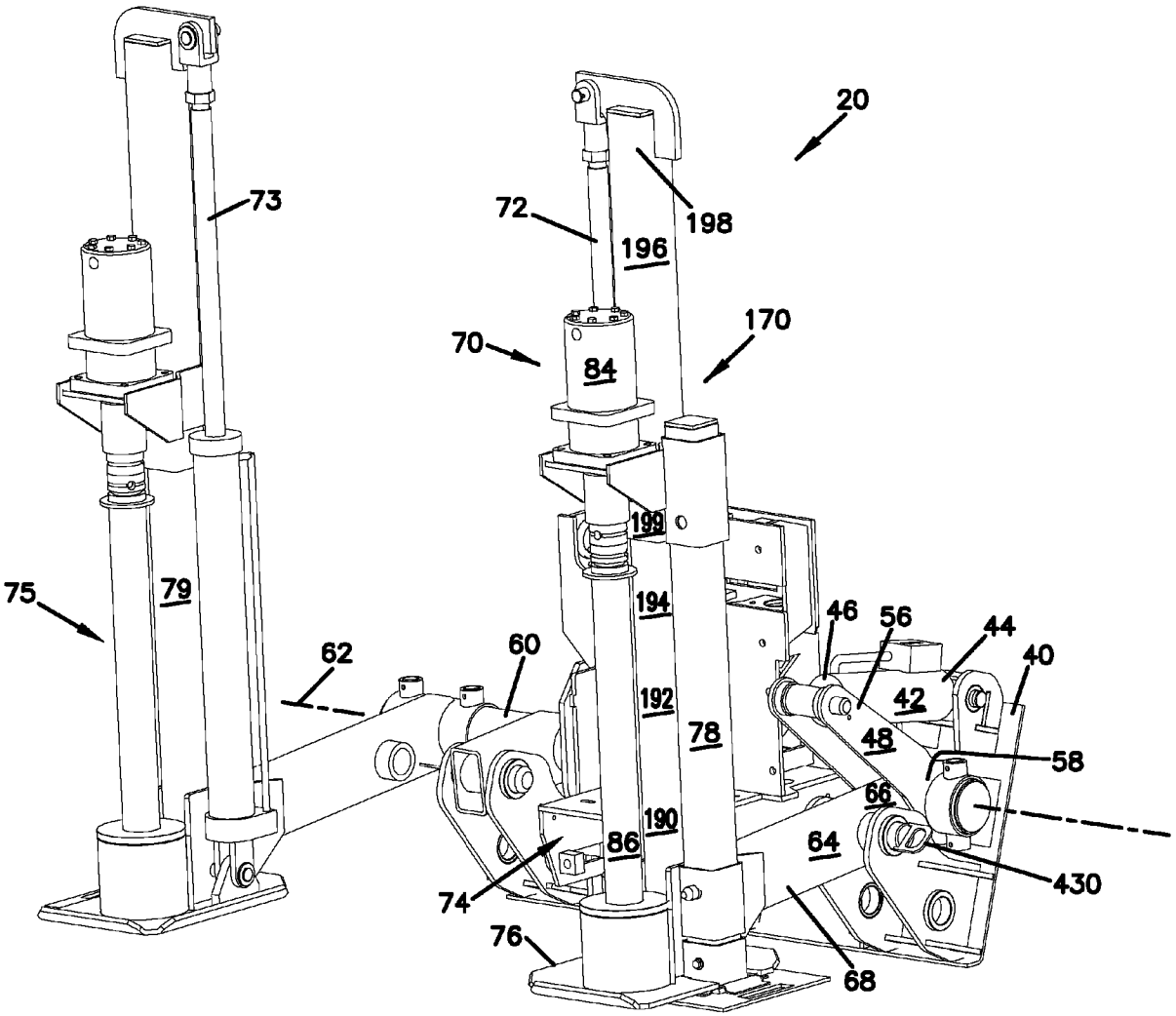
FIG. 10 is a perspective view of a drill stabilization assembly of the ground drilling machine of FIG. 1.
Figure 11:
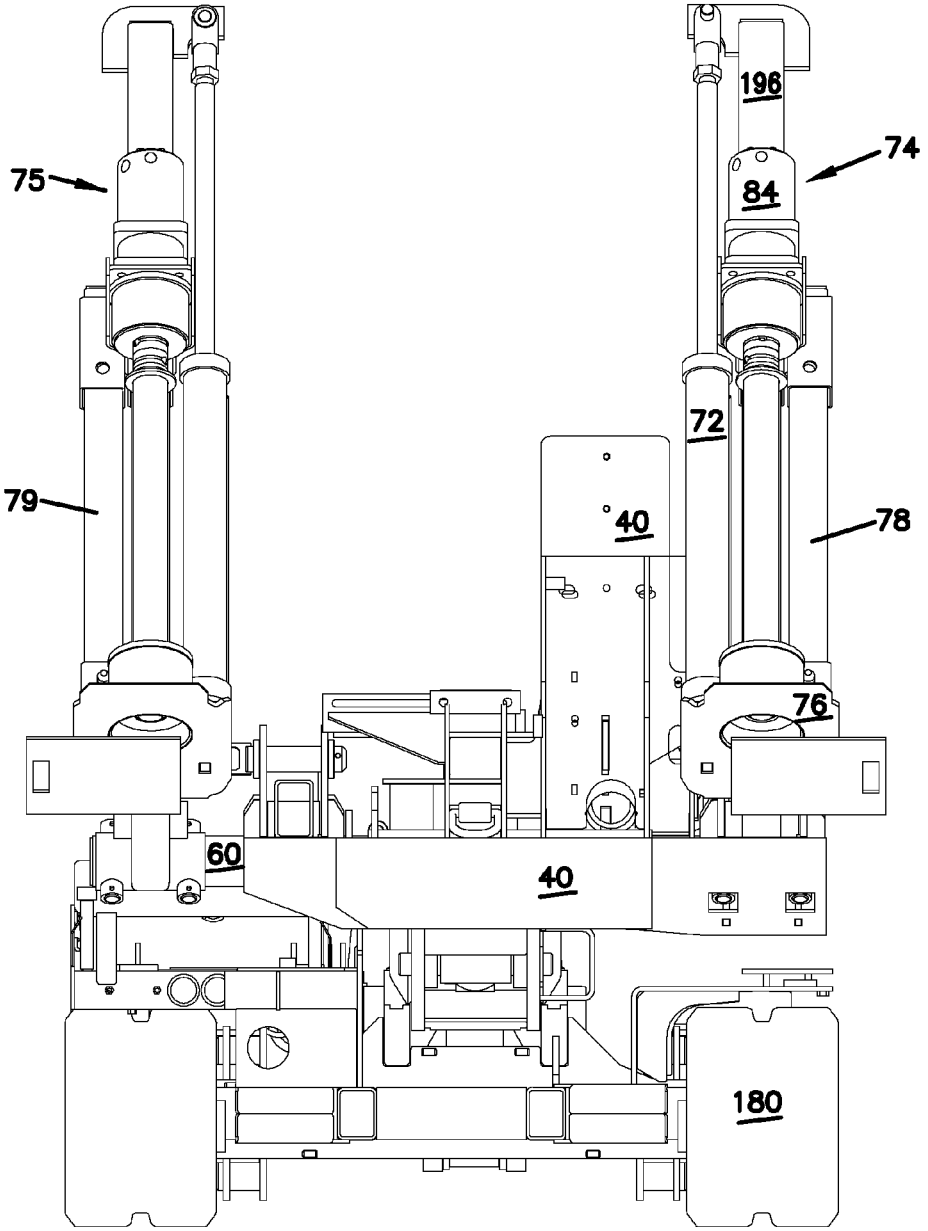
FIG. 11 is a front view of the drill stabilization assembly of FIG. 10.
Figure 12:
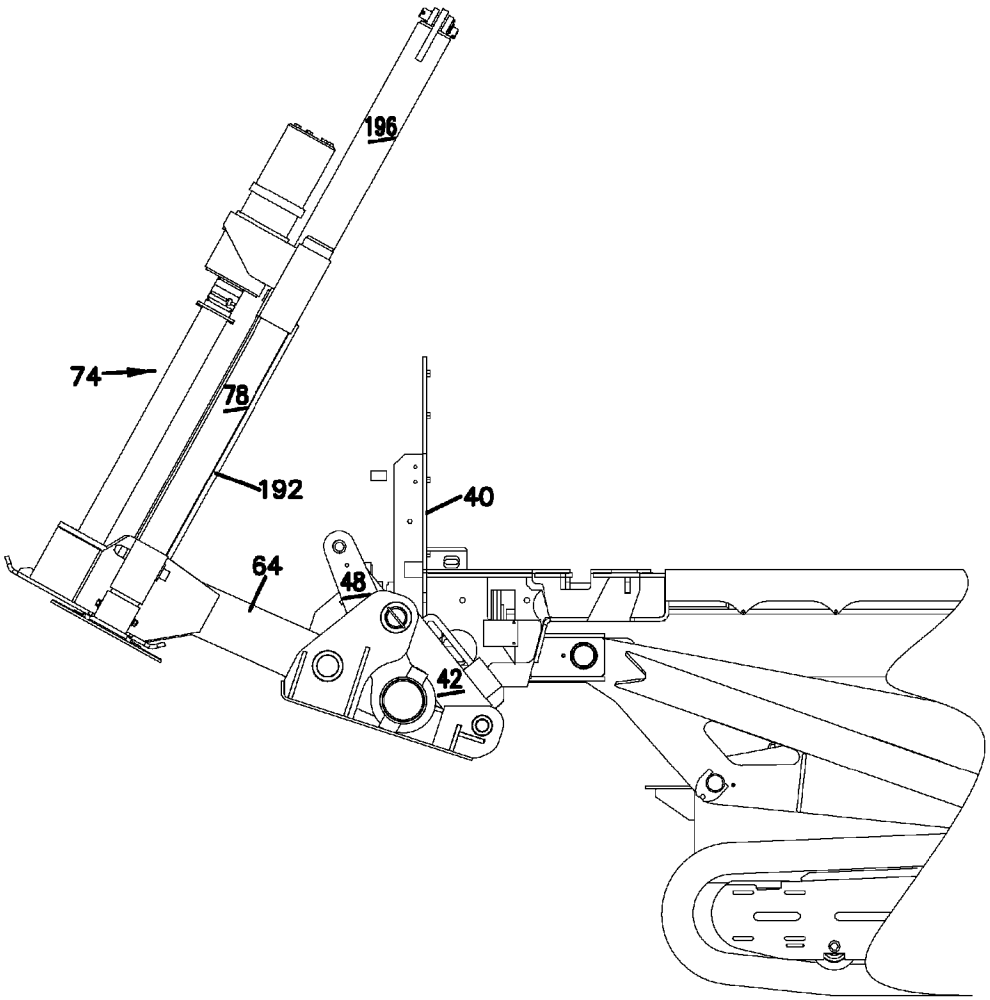
FIG. 12 is a side view of the drill stabilization assembly of FIG. 10 connected to the down hole end of the drilling machine.

Referring more particularly to FIGS. 10-12, the angular orientation relative to the rack of the stabilization leg 78 and anchor 74 on a first side and the stabilization leg 79 and anchor 75 on a second side are tied together via a pivot tube 60. The pivot tube is driven by an orientation cylinder 42 that is arranged and configured such that when the cylinder extends and retracts, the extension arms 64 that carry the stabilization legs and anchors of the stabilization subassembly 170 pivot relative to the frame 40. The mounting frame 40 connects the drill stabilization assembly 20 to the down hole end 50 of the drilling machine 10. In the depicted embodiment, the mounting frame 40 is connected to the rack 100 of the drill rod driving assembly 14. In the depicted embodiment the stabilization legs and anchors are carried by the arms 64 to a stowed position adjacent the rack and a stabilization position offset from the rack. The arms 64 provide an offset length of at least 1 foot (e.g., 1 foot, 3 feet, or six feet) for providing space for an operator station 420 (see FIG. 3).

In the depicted embodiment the orientation cylinder 42 includes a first end 44 and a second end 46. The first end 44 of the orientation cylinder 42 is connected to the mounting frame 40, and the second end 46 of the orientation cylinder 42 is connected to a first end 56 of a driving arm 48. In the depicted embodiments the connections on either end of the orientation cylinder 42 are pivot connections. The driving arm 48 includes a second end 58 that is connected to a first end 66 of an extension arm 64. The connection between the driving arm 48 and the extension arm is also a pivot connection. The pivot motion at the connection drives the rotation of the pivot tube 60 about pivot axis 62. When the orientation cylinder is extended, the pivot tube 60 rotates in a counter clockwise direction, resulting in a downward rotational movement of the stabilization subassembly 170 away from the chassis of the drilling machine (see FIGS. 2 and 5). When the orientation cylinder is retracted, the pivot tube rotates in a clockwise direction, resulting in an upward rotational movement of the stabilization subassembly 170 towards the chassis 12 of the drilling machine (see FIGS. 1, 3, 4, and 6). Pins or other fasteners can be used to secure the arms 64 in the stowed or stabilization positions (e.g., pins 430 are configured to secure the arms in a horizontal drilling orientation). It should be appreciated that many alternative configurations and arrangements are also possible. For example, in one alternative embodiment the legs and anchors adjacent the down hole end of the drilling machine are positioned off to the sides of the machine rather than at the end of the machine.

In the depicted embodiment, the stabilization leg 78 and anchor 74 on a first side can be extended or retracted independent from the stabilization leg 79 and anchor 75 on a second side. This configuration enables the drill stabilization assembly to level the drilling machine 10 on a sideways sloping ground surface. In the depicted embodiment the anchor 74 is configured to extend at least six inches below a ground surface, and the stabilization leg 79 is configured to press down on the ground surface.

In the depicted embodiment, the components of stabilization subassembly 170 on the first and second sides of the stabilization assembly 20 are similar, so only the components on the first side are described in detail herein. In the depicted embodiment, the extension arm 64 includes a second end 68 that is connected to a lower portion 190 of a first slide member 192. The stabilization subassembly 170 includes a second slide member 196 that slidably engages an upper portion 194 of the first slide member 192 (e.g., the members 192, 196 can have a telescopic relationship). The stabilization subassembly 170 includes a push down cylinder 72 that is configured to move the first slide member 192 relative to the second slide member 196. It should be appreciated that many alternative configurations and arrangements are also possible.

In the depicted embodiment, a stakedown assembly 70 is connected to the second slide member 196 such that it is moved downwardly relative to the first slide member 192 when the push down cylinder 72 is retracted, and moves upwardly relative to the first slide member 192 when the push down cylinder 72 is extended. In the depicted embodiment, the push down cylinder 72 is connected at a lower end to the first slide member 192 and connected at an upper end 198 to an upper end of the second slide member 196. In the depicted embodiment the upper end 194 of the first slide member is received in the lower end 199 of the second slide member 196 such that the first slide member 192 and second slide member 196 are arranged in a telescoping manner. It should be appreciated that many alternative configurations and arrangements are also possible.

In the depicted embodiment the stakedown assembly 70 includes a push down cylinder 72, a ground anchor 74, the ground anchor 74 including a drill shaft 86 that is driven by a motor 84. The drill shaft 86 is configured to extend through a foot 76. The foot 76 is connected to the lower end of the push down cylinder 72 and first slide member 192. In the depicted embodiment the foot 76 includes a drill anchor flighting shroud that is configured to cover the flighting of the drill anchor and a stabilization leg cut out that allows the stabilization leg to extend past the foot 76.

In the depicted embodiment the stabilization subassembly 170 further includes a stabilization leg 78 that rests on the ground rather than anchoring into the ground. The stabilization leg 78 can be configured to selectively move with the second slide member 196 or, alternatively, to allow the second slide member 196 to move relative to the stabilization leg 78. When the stabilization leg 78 is configured to move with the second slide member 196, the foot 1002 of the stabilization leg 78 (rather than the ground anchor 74) engages the ground. Thus, cylinder 72 can be used to independently raise and lower the anchor relative to the stabilization leg, or lower and raise the anchor and the stabilization legs in unison.

In the depicted embodiment, the drill stabilization assembly 20 includes a mounting frame 40 configured to connect the drill stabilization assembly to a drilling machine; a drill stabilization subassembly 170 connected to the mount frame, the drill stabilization subassembly 170 including a portion that can retract and extend; an orientation actuator (e.g., an hydraulic cylinder) configured to pivot the drill stabilization subassembly 170 relative to the mount frame; a push down actuator 72, 73 configured to extend and retract the portion of the drill stabilization subassembly that can retract and extend. The stabilization assembly 20 further includes a first slide member 192 connected to the mounting frame and an end of the push down actuator, and a second slide member 196 slidably connected to the first slide member, wherein a stakedown anchor is connected to the second slide member such that when the actuator contracts, the stakedown anchor extends. The portion of the drill stabilization subassembly 170 that can retract and extend includes a stabilization leg configured to press down on the ground surface, the stabilization leg is connected to the second slide member such that when the actuator contracts the stakedown anchors extend. The stabilization leg can be released from the second slide member such that when the actuator contracts, only the stakedown anchor extends. It should be appreciated that many alternative configurations and arrangements are also possible. For example, in one alternative embodiment the leg 78 is eliminated and the foot 1002 directly attaches to the ground anchor 74.

In the depicted embodiment the ground drilling machine the drill stabilization assembly is configured to stabilize the down hole end of the drill rod driving assembly. In accordance with one embodiment, the drill stabilizer assembly of the depicted embodiment comprises a mount frame connected to the down hole end of the drill rod drive assembly; a stabilizer orientation cylinder including a first end and a second end, the first end connected to the mount frame; a driving arm including a first end and a second end, the first end being connected to the second end of the orientation cylinder; a pivot tube including a pivot axis that is fixed relative to the mounting frame, the pivot tube connected to the second end of the first arm such that the pivot tube rotates when the driving arm moves; an extension arm including a first and second end, the first end connected to the pivot tube; a stakedown assembly connected to the second end of the extension arm, the stakedown assembly including: a push down cylinder; a ground anchor; and a stabilization leg; and wherein the stakedown includes an anchor position in which the push down cylinder is contracted and the anchor is extended relative to the stabilization leg, wherein the stakedown includes a support position cylinder that is contracted and the anchor of the push down cylinder extends the foot relative to the mount frame, wherein the stakedown includes a retracted position in which the push down cylinder is extended and the anchor and stabilization leg are retracted, and wherein the stakedown assembly pivots relative to the mount frame when the stabilizer orientation cylinder extends and retracts.

As discussed above, operator controls are provided at the operator station 420 adjacent the down hole end of the drilling machine. In addition, operator controls are also provided, as well, at the operator auxiliary control station 1004 adjacent the up hole end of the machine. In the depicted embodiment an operator at control station 420 can drive the ground anchor into the ground. In other words, the operator can control the motor 84 and cylinder 72 from station 420. In the depicted embodiment, an operator at the auxiliary control station can raise the machine relative to the ground (i.e., control cylinder 72), but not drive the ground anchor into the ground (i.e., control the motor 84). In the depicted embodiment, the control of the motor 84 is also disabled when the rack is oriented at a high angle (e.g., greater than 45 degrees relative to the horizontal). This automatic disabling of the rotational control encourages operators to use the stabilization assembly 20 to raise the drilling machine relative to the ground surface during typical geothermal drilling applications, as opposed to having the drilling machine supported on its tracks with the ground anchors driven into the ground.

Referring generally to FIGS. 1-6 and 13-15, the drill rod drive assembly 14, the rod loading assembly 102, and the vise assembly 112 of the depicted embodiment are described in greater detail. As discussed above, the drill rod drive assembly 14 is configured to drive the drill string into or out of the ground as well as rotate the drill string about the drill string rotational axis.

In the depicted embodiment the drill rod drive assembly 14 includes a rack 100 and a drive unit 104. The drive unit 104 is configured to move between the up hole end 52 and the down hole end 50 of the rack 100. The drive unit 104 includes motors that drive movement of the drive unit 104 relative to the rack 100 and motors that drive the rotation of the drill string 200. The drive unit 104 rotates the drill rods to thread or unthread them from the drill string 200. In addition, the drive unit rotates the drill string to drive the rotation of the cutting tool 202 attached at the down hole end of the drill string. As discussed above, the rack 100 can be raised and lowered via the drill adjustment assembly 90, and the down hole end 50 of the rack 100 can be stabilized during drilling operations via the drill stabilization assembly 20.

The rod loading assembly 102 is configured to deliver drill rods to and from the drill rod drive assembly 14. The rod loading assembly 102 includes upper and lower loader arms 106, 108 configured to move rods to and from the rack 100, a rod box 18 for storing rods, and hold down assemblies 16, 17.

Figure 13:
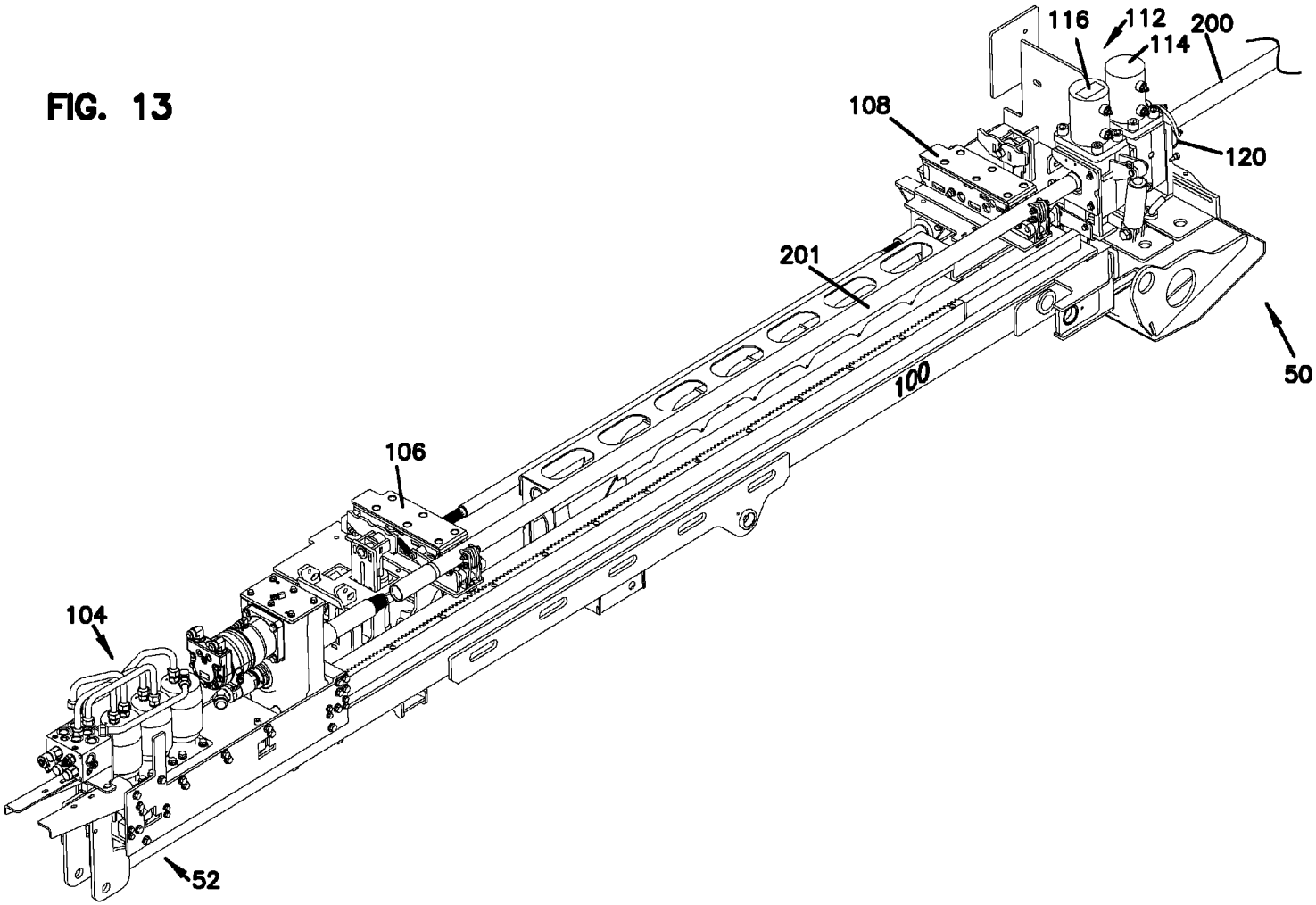
FIG. 13 is a perspective view of a drill rod drive assembly, vise assembly, and portions of a rod loading assembly of the ground drilling machine of FIG. 1 in a first orientation.

In the depicted embodiment the upper and lower loader arms 106, 108 move from a first drill string position shown in FIG. 13 to a second rod box position shown in FIGS. 14 and 4-6. In the first drill string position the upper and lower loader arms 106, 108 are extended such that the drill rod secured therein is aligned with the drive unit 104 and the drill string (not shown). In the second rod box position the upper and lower loader arms are positioned under the rod box 18 so that it can either deliver a drill rod to the rod box or receive a drill rod from the rod box. In the depicted embodiment the sliding movement of the loader arms 106, 108 is synchronized by a sync bar 110. In the depicted embodiment rotation of the sync bar 110 drives the translation motion of the loader arms 106, 108. It should be appreciated that many alternative configurations and arrangements are also possible.

In the depicted embodiment the hold down assemblies 16, 17 of the rod loading assembly 102 are configured to drive the rods in the rod box towards the loader arms 106, 108. In the depicted embodiment the hold down assemblies 16, 17 forces the rods in the rod box against the rod lifter 1044, which is actuated (raised and lowered) by a cylinder 1022 (e.g., hydraulic cylinder). The rod lifter 1044 functions as a movable bottom of the rod box 18 and is configured to push rods back into the rod box 18 when the drill string is being retracted and disassembled. In the depicted embodiment the lifter 1044 pushes the rods in a direction that is opposite the direction that the push rods push the rods. Other example rod lifting and transferring systems are disclosed in U.S. Pat. Nos. 7,694,751; 5,607,280; 6,474,932; 6,332,502; and 5,556,253. The above listed patents are incorporated herein by reference in there entirety.

Figure 29:
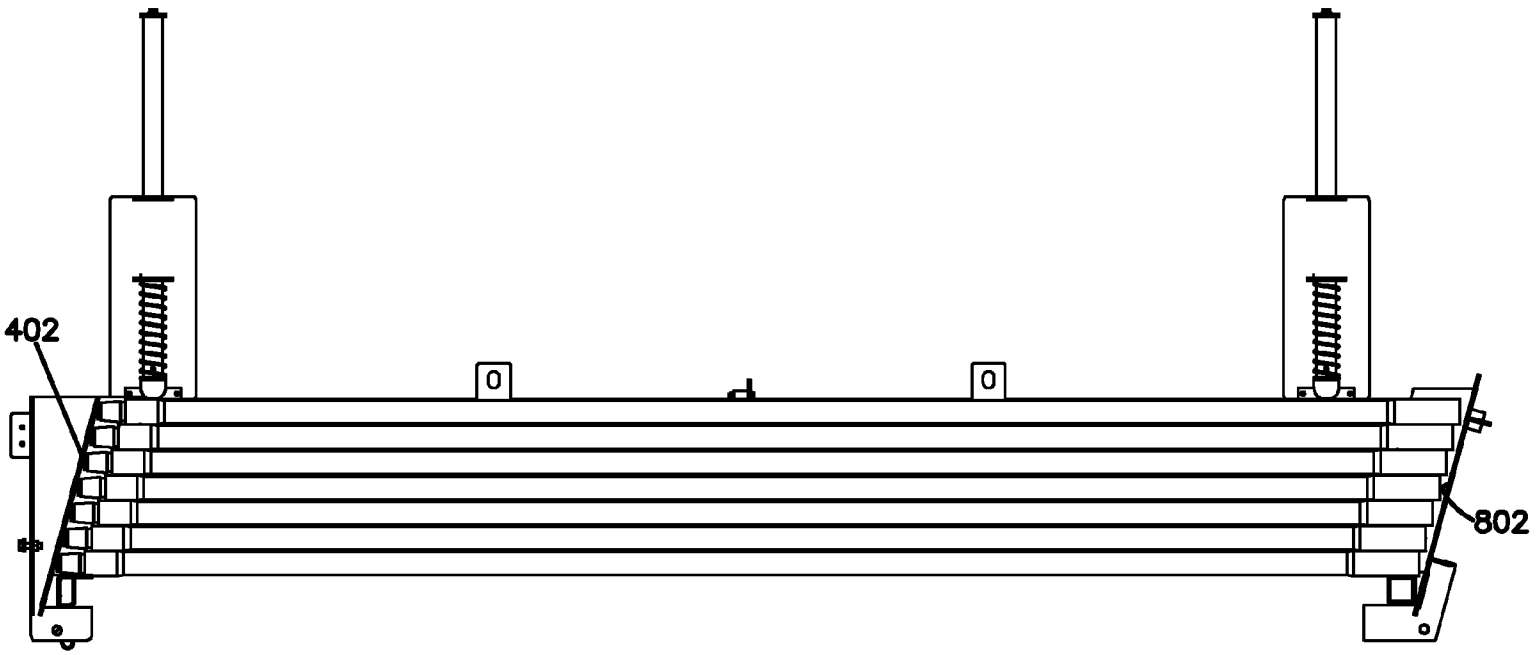
FIG. 29 is a cross-sectional view of a rod box of FIG. 23.

In the depicted embodiment, when the rod box is in a horizontal or near horizontal orientation, the rods within the rod box 18 are naturally biased by gravity towards the bottom opening of the rod box 18. However, when the rod box 18 is vertical or near vertical, the gravitational force that typically biases the drill rods towards the bottom opening of the rod box 18 may be insufficient. Accordingly, the hold down assembly is configured to push the drill rods that are in the rod box towards the bottom opening of the rod box 18 to facilitate rod transfer between the rod box 18 and the loader arms 106, 108. In the depicted embodiment the down hole end of the rod box has an angle surface 402 that directs the rod toward the rod box rod discharge opening (see FIGS. 2, 4, and 29). This angle surface can work in concert with the hold down assemblies to ensure that drill rods in the rod box are biased toward the discharge opening even when the rod box is in a vertical orientation relative to the ground surface. Referring to FIG. 29, the angle surface 402 at the down hole end of the rod box 18 forms an acute angle (e.g., 60 degrees) with respect to a plane parallel to the length of the rods of the rod box 18. In the depicted embodiment the up hole end of the rod box 18 also includes an angled surface 802; the angled surface is oriented at an obtuse angle (e.g., 120 degrees) relative to the a plane parallel to the length of the rods of the rod box 18. It should be appreciated that many alternative configurations and arrangements are also possible.

Figure 14:
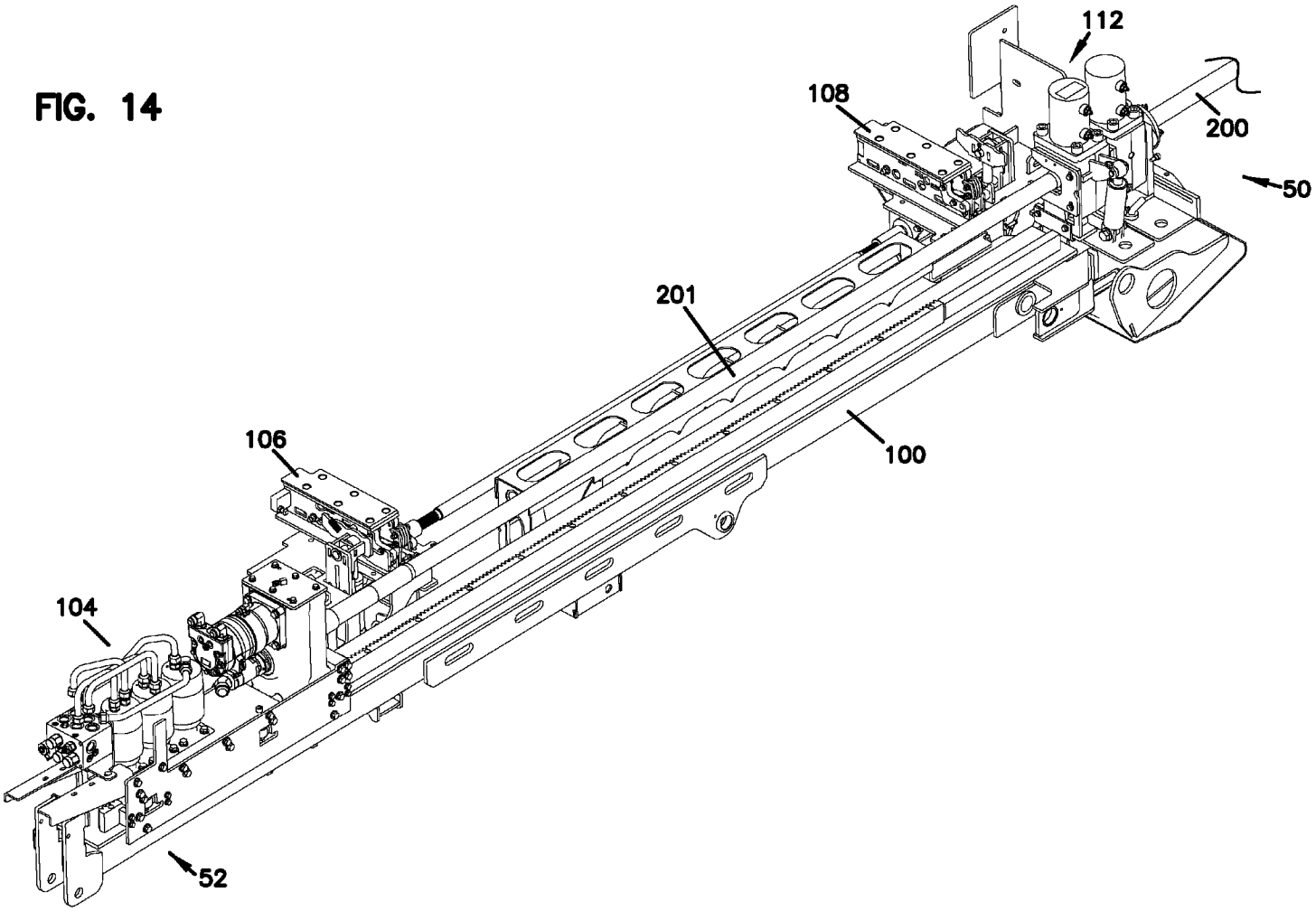
FIG. 14 is a perspective view of a drill rod drive assembly, vise assembly, and portions of the rod loading assembly of FIG. 13 in a second orientation.
Figure 15:
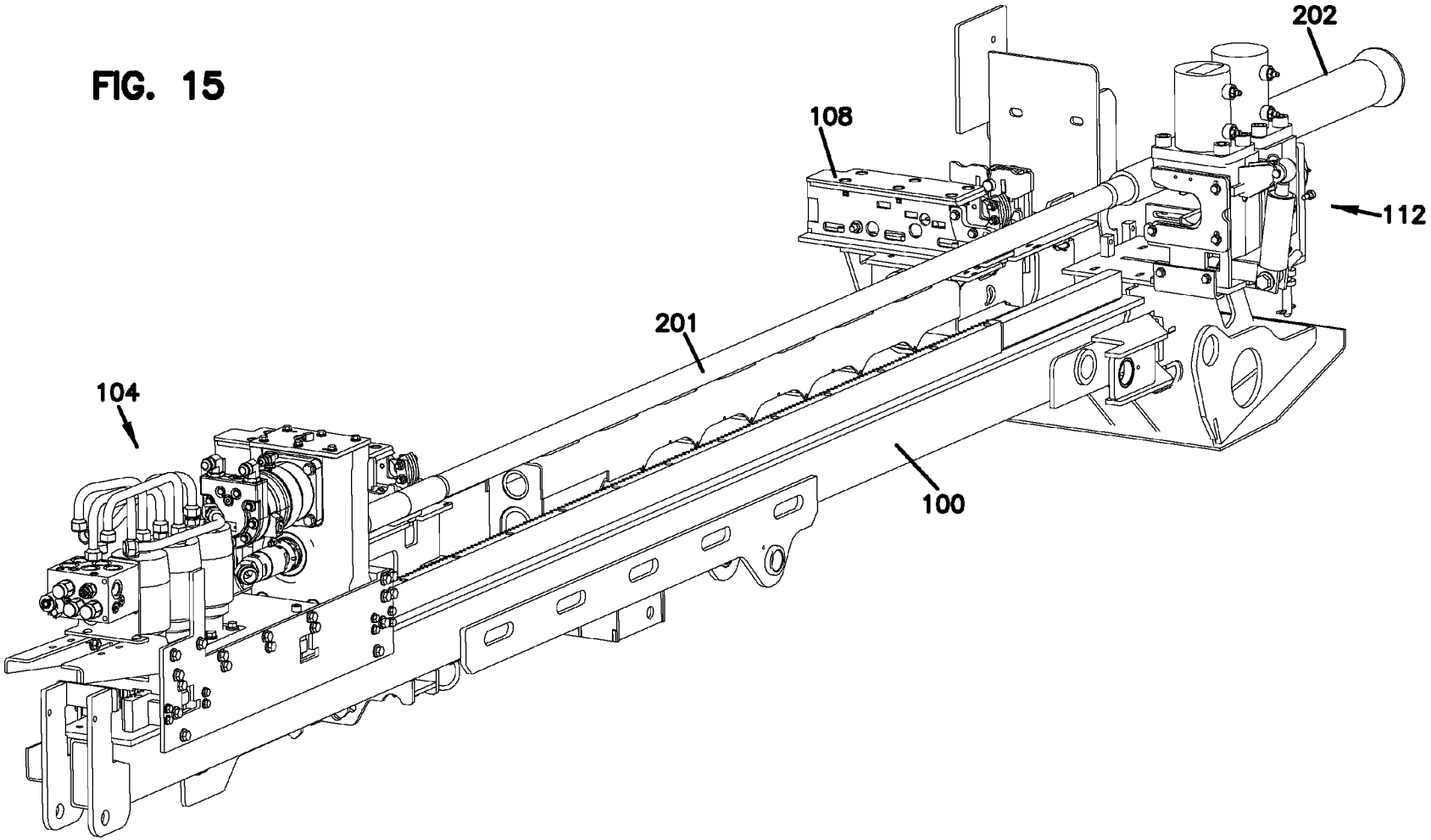
FIG. 15 is a perspective view of a drill rod drive assembly, vise assembly, and portions of the rod loading assembly of FIG. 13 in a third orientation.

In the depicted embodiment, the vise assembly 112 is configured to facilitate making up or breaking down the drill string. In the depicted embodiment, the vise assembly 112 secures the down hole end of a drill rod that is positioned to be either added to the drill string or removed from the drill string as well as the up hole end of the drill string. The vise assembly 112 is arranged such that it can be aligned with the drill string and drive unit 104 as shown in FIGS. 13 and 14 or, alternatively, moved out of alignment as shown in FIG. 15. It can be desirable to move the vise out of alignment when the drill rod that is attached to the drilling tool 202 is being worked on. Sliding the vise out of alignment allows for drilling tool 202 having larger diameters and lengths (drilling casing, air hammers, etc.) to be easily attached and detached from the drill rods. The sliding vise also allows the rod to be aligned with, or removed from alignment with, the drill string while the drilling tools are attached to the drill rod. For example, it may be desirable to move the vise assembly out of alignment when the cutting tool is being changed or when the drill rod attached to the cutting tool is being moved into or out of position or if it is too large to pass through the axial opening of the vise. It should be appreciated that many alternative configurations and arrangements are also possible.

Figure 16:
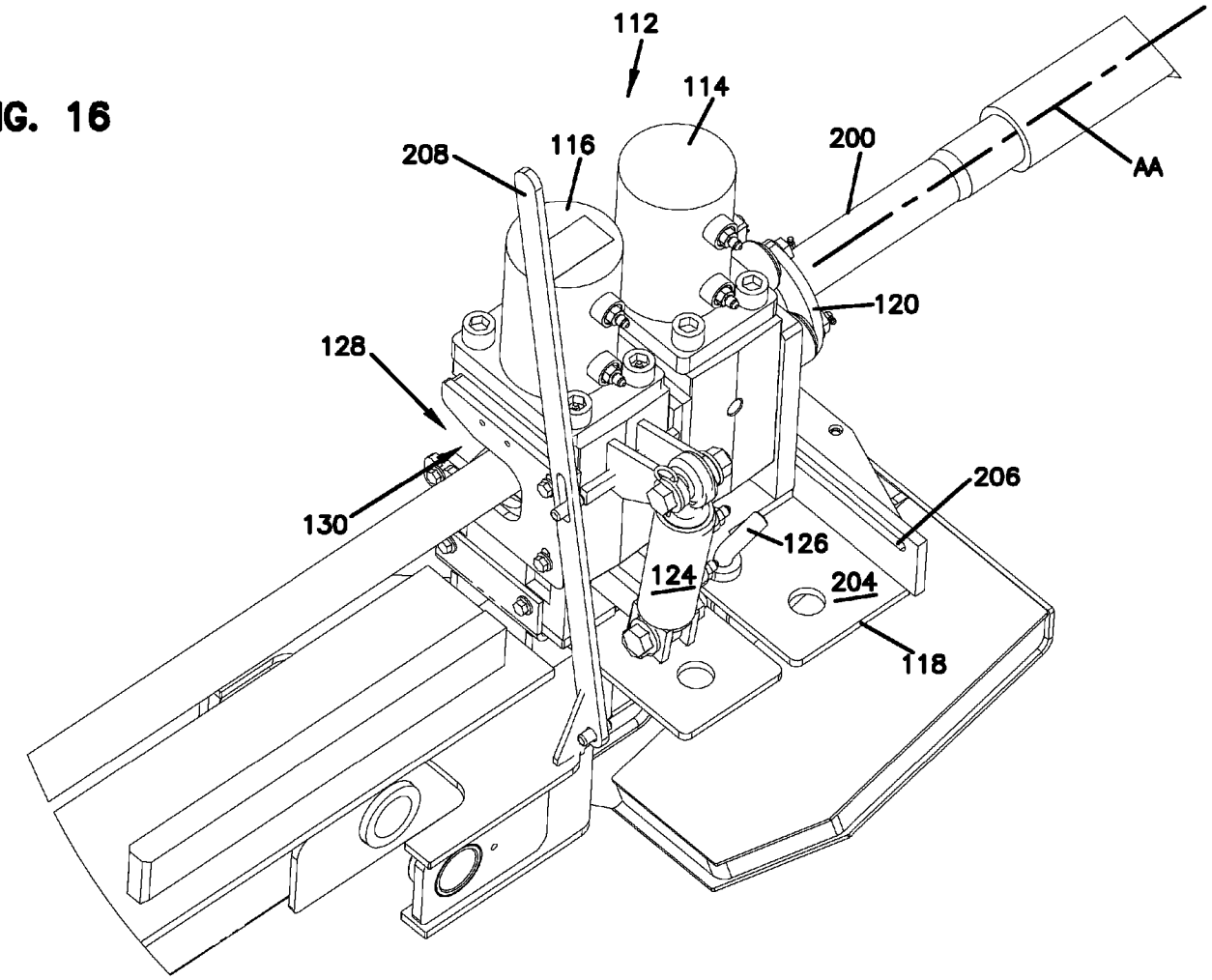
FIG. 16 is a first perspective view of the vise assembly of FIG. 13 in a first orientation.
Figure 17:
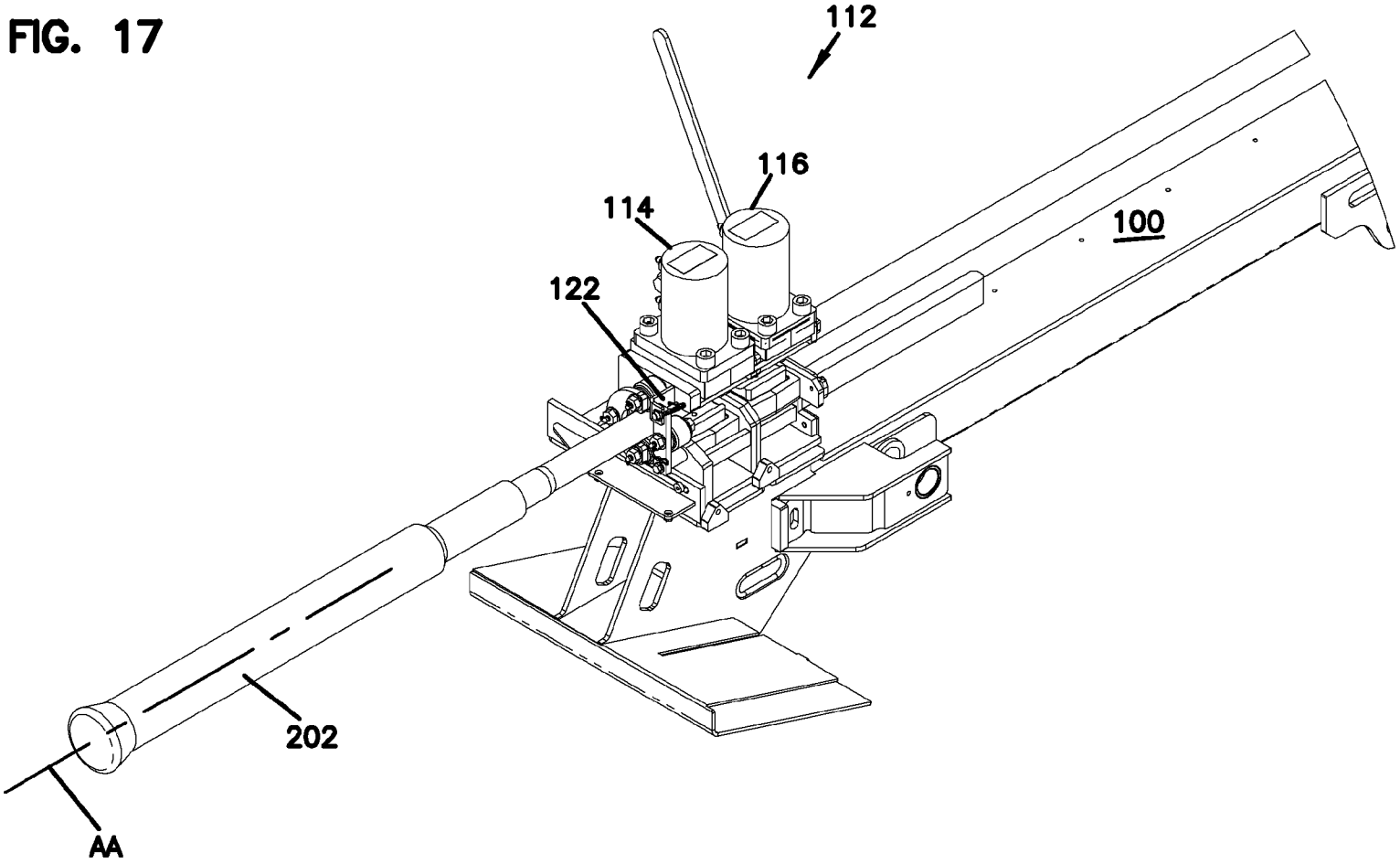
FIG. 17 is a second perspective view of the vise assembly of FIG. 13 in a first orientation.
Figure 18:
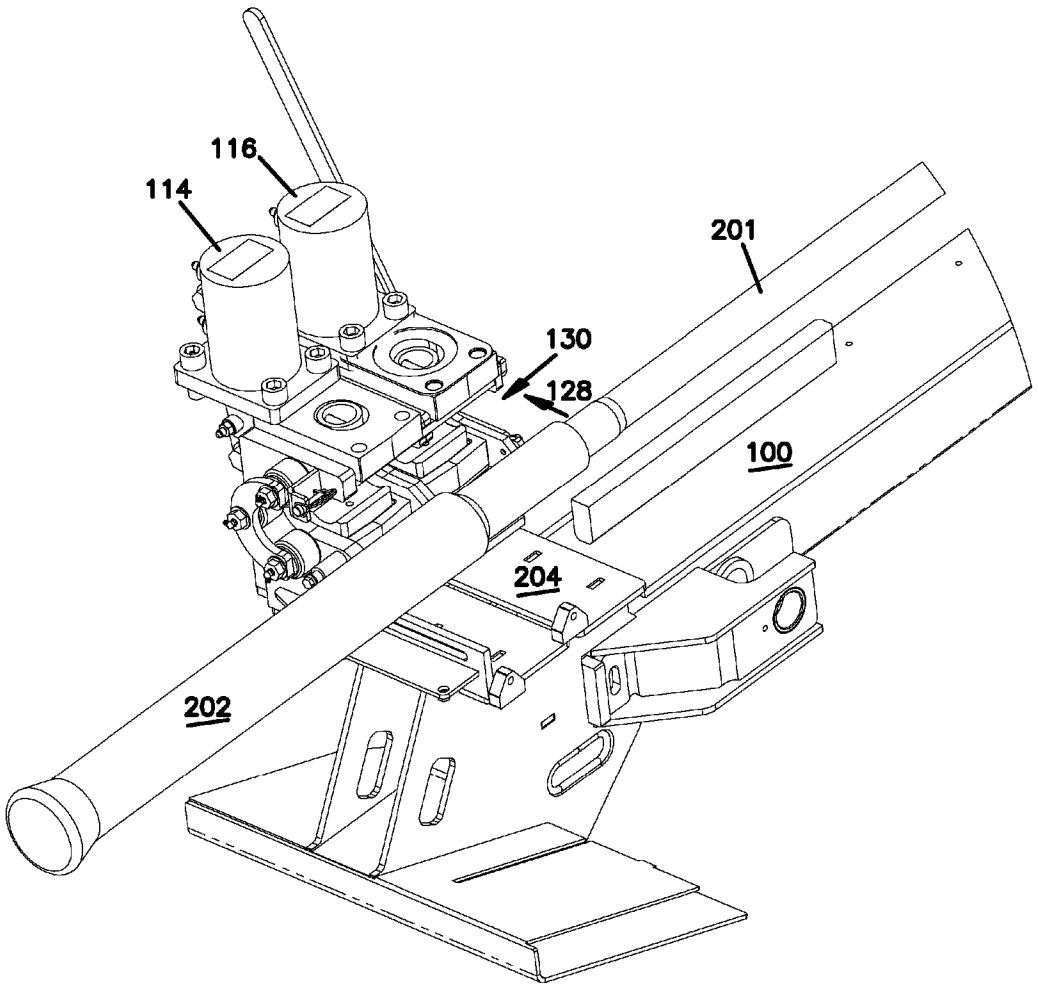
FIG. 18 is a perspective view of the vise assembly of FIG. 13 in a second orientation.
Figure 19:
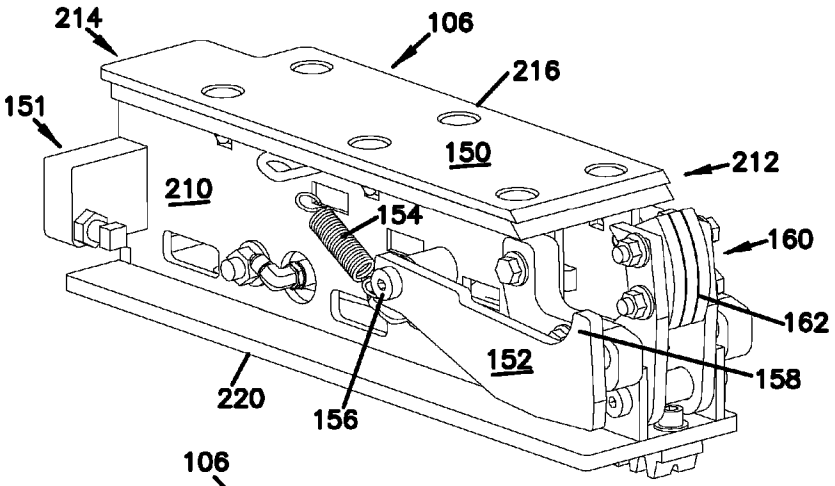
FIG. 19 is a first side perspective view of a loader arm of the rod loading assembly of FIG. 13 showing the finger in a closed position.
Figure 20:
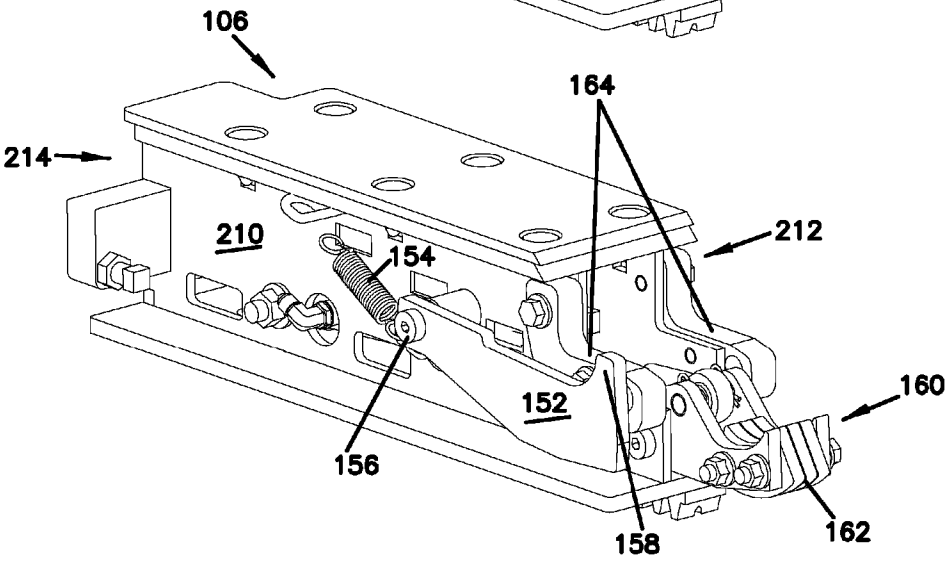
FIG. 20 is a first side perspective view of a loader arm of the rod loading assembly of FIG. 13 showing the finger in an open position.

Referring to FIGS. 16-18, the vise assembly 112 of the depicted embodiment is described in greater detail. The vise assembly 112 includes a first vise 114 and a second vise 116. The first vise 114, also referred to as the lower vise, is closer to the down hole end 50 of the rack as compared to the second vise 116, which is also referred to as the upper vise. The first vise 114 is configured to clamp onto the up hole end of the drill string, while the second vise 116 is configured to clamp onto the down hole end of the drill rod that is being removed from the drill string 200. In the depicted embodiment the first and second vises are configured to be able to rotate relative to the anchor about the drill string axis AA relative to each other to break the threaded connection between the down hole end of the drill rod and the up hole end of the drill string. In the depicted embodiment the second vise 116 rotates while the first vise remains stationary. In the depicted embodiment the second vise 116 is connected to a torque cylinder 124 that rotates the second vise when it extends and retracts.

In the depicted embodiment the first and second vises 114, 116 include axial rod receiving opening 130 that is configured to receive a drill rod and allow the rod to pass through as the drill string is pushed into the ground by the drive unit 104 or pull out of the ground by the drive unit 104. The first and second vises 114, 116 also include a side opening 128 that allows the vise to slide away from the drill string. In the depicted embodiment a gate 122 is positioned to close the side opening and retain the drill string in alignment with the first and second vises 114, 116 (the gate 122 is shown closed in FIG. 17 and open in FIG. 18). In the depicted embodiment the gate 122 is adjacent a guide assembly 120 (roller assembly), which is configured to support the drill string as it rotates within the vises 114, 116. It should be appreciated that many alternative configurations and arrangements are also possible.

In the depicted embodiment, the vise assembly includes a slide unit 118 that includes a base plate 204, a slide slot 206, a locking pin 126, and a slide lever 208. In the depicted embodiment, the slide unit 118 enables the vises to move into alignment with the drill string and drive unit 104 or, alternatively, to move out of alignment with the drill string and drive unit 104 (e.g., the vises can be moved three inches to the side, six inches to the side, a foot to the side, etc.). The locking pins 126 locks the vises in position relative to the base plate 204. To move the vises 114, 116 out of alignment from the drill string, the operator can pull the locking pin 126 and manually move the slide lever 208 resulting in the vises 114, 116 sliding along the slide slot 206 relative to the base plate 204. To move the vises 114, 116 into alignment, the operator can move the slide lever 208 in the opposite direction and reengage the locking pin 126. In the depicted embodiment the vise assembly is configured to slide into and out of alignment with the drill string axis in a direction substantially perpendicular to the drill string axis. In the depicted embodiment, the vise assembly is configured to slide at least three inches out of alignment with the drill string and more preferably at six inches out of alignment with the drill string. It should be appreciated that many alternative configurations and arrangements are also possible.

In the depicted embodiment, a ground drilling is initiated by positioning the drill rod along a drill string axis; positioning a vise assembly out of alignment with the drill string axis; connecting a drilling tool to the drill rod; driving the drill rod with the drill in the down hole direction, repositioning a vise assembly into alignment with the drill string axis; and driving the drill rod further into the ground. In the depicted embodiment the step of connecting the drilling tool to the drill rod occurs while the vise assembly is positioned out of alignment with the drill string axis.

The ability of the vise assembly 112 to move out of alignment with the drill string enable the drilling machine to pull a drilling tool onto the rack without interfering with the vises. In particular, once the hole is drilled, the drilling tool 202 of the drill string can be removed from the ground by positioning the vise assembly out of alignment with the drill string axis, retracting the drill rod with a drilling tool attached thereto along a drill string axis, detaching the drilling tool from the drill rod, and repositioning the vise assembly into alignment with the drill string axis. In the depicted embodiment the step of detaching or fully retracting the drilling tool occurs while the vise assembly is positioned out of alignment with the drill string axis. Breaking down the drill string includes the step of clamping the drill rod with the drill vise assembly and breaking the connection between the drill rod and a drive unit. When the last drill rod is pulled up, the drilling tool can be detached from the drill rod while the vise assembly is out of alignment with the drill string axis. After the drilling tool is removed, the vise assembly can be realigned with the drill string axis and clamped onto the drill rod for breaking the connection between the last drill rod and a drive unit.

Referring to FIGS. 19-22, the loading arms 106, 108 of the depicted embodiment are described in greater detail. In the depicted embodiment, the translation motion of the upper loader arm 106 and lower loader arm 108 relative to the rod box is synchronized. The upper loader arm 106 and the lower loader arm 108 are configured to receive drill rods from a rod box in a first direction (e.g., substantially vertical direction when the rack is horizontal) and discharge drill rods to a rack in a second direction (e.g., substantially horizontal direction when the rack is horizontal).

In the depicted embodiment the upper loader arm 106 and the lower loader arm 108 are substantially identical, therefore, only the features of the upper loader arm will be described herein in detail. In the depicted embodiment the upper loader arm 106 includes a main body 210 including a first end 212, a second end 214, a top portion 216, a bottom portion 220, an upper surface 150, and a lower surface 400. In the depicted embodiment the upper surface 150 (also referred to herein as slide surface) is provided on the top portion 216 of the main body and is configured to slide against the rods in the rod box 18. A movable position stop components 166 are located on the side of the main body for controlling the position of the load arm under the rod box so that the load arm 106 stops under the desired column of rods in the rod box (see FIG. 21). In the depicted embodiment, a limit adjuster 151 is provide at the second end 214 of the main body 210 for limiting the total travel of the loading arm 106 relative to the rod box 18. In the depicted embodiment the main body has a height L1 of about 24 inches. It should be appreciated that many other alternative configurations are also possible.

In the depicted embodiment, the loading arm 106 includes a finger 160 at the first end 212 of the main body 210. The finger 160 is configured to pivot about a finger pivot 282 located at the first end 212 adjacent the bottom portion of the main body 210. In the depicted embodiment the finger 160 is opened and closed as a result of the contraction and extension of a grip cylinder 280 that is located within the main body 210 of the loader arm. The grip cylinder 280 includes an end connected to the main body 210 and another end connected to the finger 160 at a grip cylinder pivot 224, which is between the distal end of the finger and the finger pivot 282. In the depicted embodiment the finger length L2 is about 3.5 inches, the distance L3 between pivot 282 and connection point 284 is about 1.25 inches, the distance L4 between connection point 284 and grip cylinder pivot 224 is about 13 inches. In the depicted embodiment the connection point 284 and the grip cylinder pivot 224 are located between the upper surface 150 and the lower surface 400 of the main body 210. In the depicted embodiment the connection point 284 is further from the bottom portion 220 of the load arm than is the pivot 282. In the depicted embodiment the finger is moved to a gripping position (see FIG. 20) by retracting the grip cylinder 280. It should be appreciated that many alternative configurations and arrangements are also possible.

In the depicted embodiment, a grip pad 162 is provided on the distal end of the finger 160, which helps prevent the drill rod from slipping (in any direction) relative to the finger 160 even when the rod is in a vertical or near vertical orientation relative to the ground surface. In the depicted embodiment the grip pad 162 includes a concaved drill rod contacting surface. In the depicted embodiment the grip pad 162 is comprised of a rubber material. The grip pad of the depicted embodiment has a gripping surface that has a Shore A durometer of between 50 and 70. In the depicted embodiments, wear pads 164 may be provided on either side of the finger 160 for supporting the drill rod as it drops into engagement with the fingers 160. The wear pads 164 of the depicted embodiment have a durometer that is greater than that of the grip pad 162.

Figure 21:
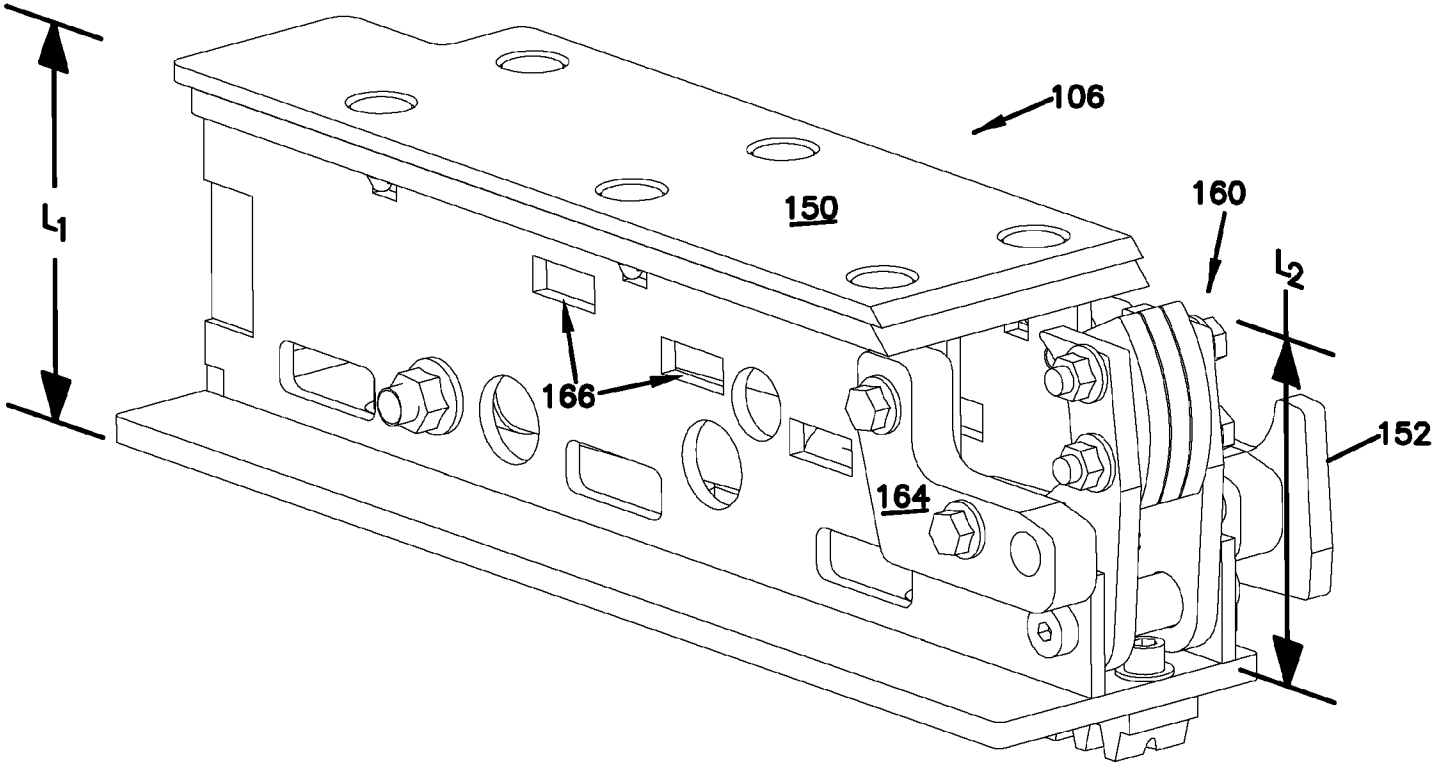
FIG. 21 is a second side perspective view of a loader arm of the rod loading assembly of FIG. 13 with the finger in a closed position.
Figure 22:
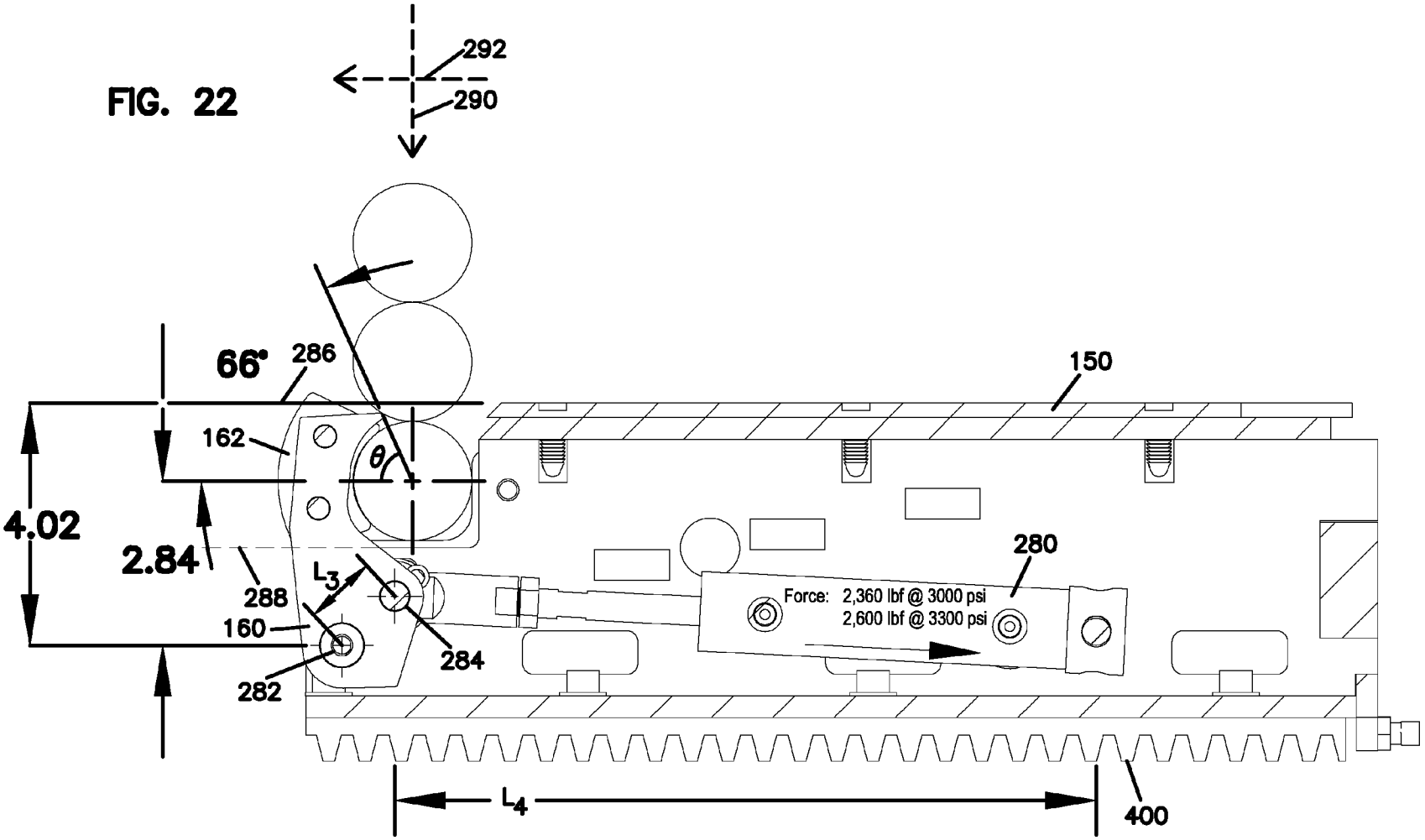
FIG. 22 is a cross-sectional view of the loader arm of FIG. 19.

In the depicted embodiment, the loader arm 106 further includes a catch arm 152 that is configured to retain the drill rod even when finger 160 is in the open position (see FIG. 21). In the depicted embodiment the catch arm 152 includes a retaining hook 158 that prevents a drill rod from rolling away from the loader arm 106 even when the finger 160 is in the open position. Accordingly, the catch arm 152 can be used in place of or in conjunction with the finger 160 in low angle drilling applications. In the depicted embodiment the catch arm 152 is connected to the main body 210 at a catch arm pivot 156. A catch arm spring 154 is used to bias the catch arm 152 in a raised position. It should be appreciated that many alternative configurations and arrangements are also possible.

In the depicted embodiment, a drill rod is transferred from a rod box by first, positioning a loader arm adjacent a rod box; second, securing a drill rod in the loader arms by actuating fingers on the loader arm; third, threading a drill rod drive unit to an up hole end of the drill rod; fourth, releasing the actuating fingers; and fifth, threading the drill rod to a drill string. In the depicted embodiment the fingers are configured to pivot about a pivot axis through a range that is greater than ninety degrees.

In the depicted embodiment, the rod loader arm includes a recess in an upper slide surface that is configured to receive the drill rod 201. The finger is configured to retain the rod in the recess by applying a force on the drill rod 201 in a direction towards the recess. In the depicted embodiment the recess is L-shaped, having a side wall and a base wall, the base wall defining a first plane, the upper slide surface defining a second plane, and the side wall defining a third plane.

Figure 23:
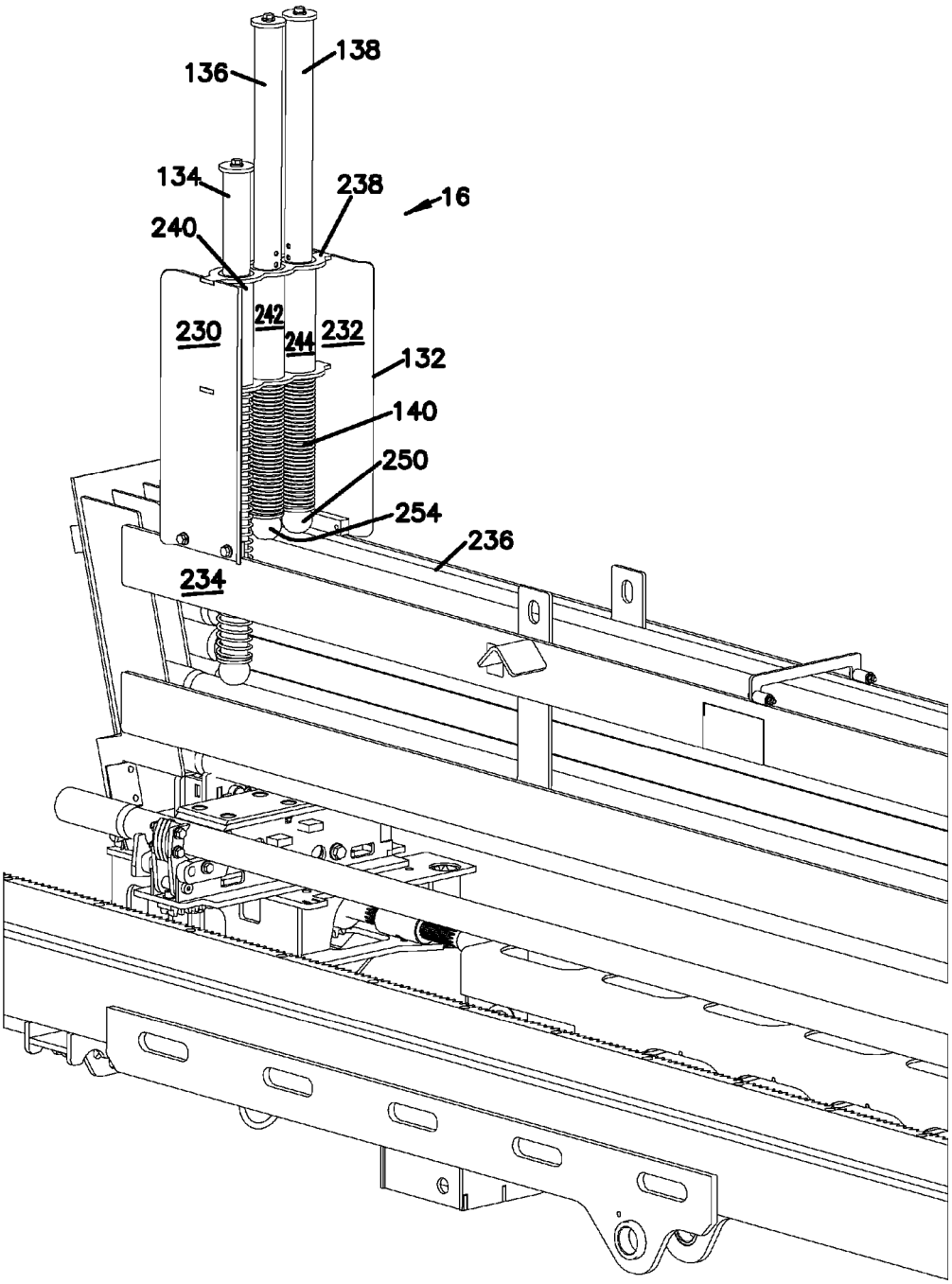
FIG. 23 is a perspective view of the rod box, and loader arm and hold down assembly of the ground drilling machine of FIG. 1.

In the depicted embodiment the proximal end of the finger is pivotally connected below to the base wall. The finger is configured to move to and from an open position to a closed position. In the open position the distal end of the finger extends past (below) the first plane which allows the load arm to release a drill rod and be pulled directly away from the drill string axis. In the closed position the distal end of the finger is between the first and second planes. In the closed position the distal end of the finger overlaps the drill rod in a plane parallel to the third plane. The degree of overlap can be described as the angle of overlap θ, which is depicted in FIG. 23. If the angle of overlap is zero, the finger would not overlap the rod in a plane parallel to the third plane at all, if the angle of overlap is 180, the finger would completely overlap the drill rod, and if the angle of overlap is 90, the finger would overlap half of the drill rod. In the depicted embodiment the angle of overlap θ is between 30 to 80 degrees (more preferably between 50 to 70 degrees). This configuration facilitates the load arm traveling under the rods in the rod box with the finger in any position, and allows the drill rods to be released from the load arm without pivoting or lowering the rod arm.

Figure 24:
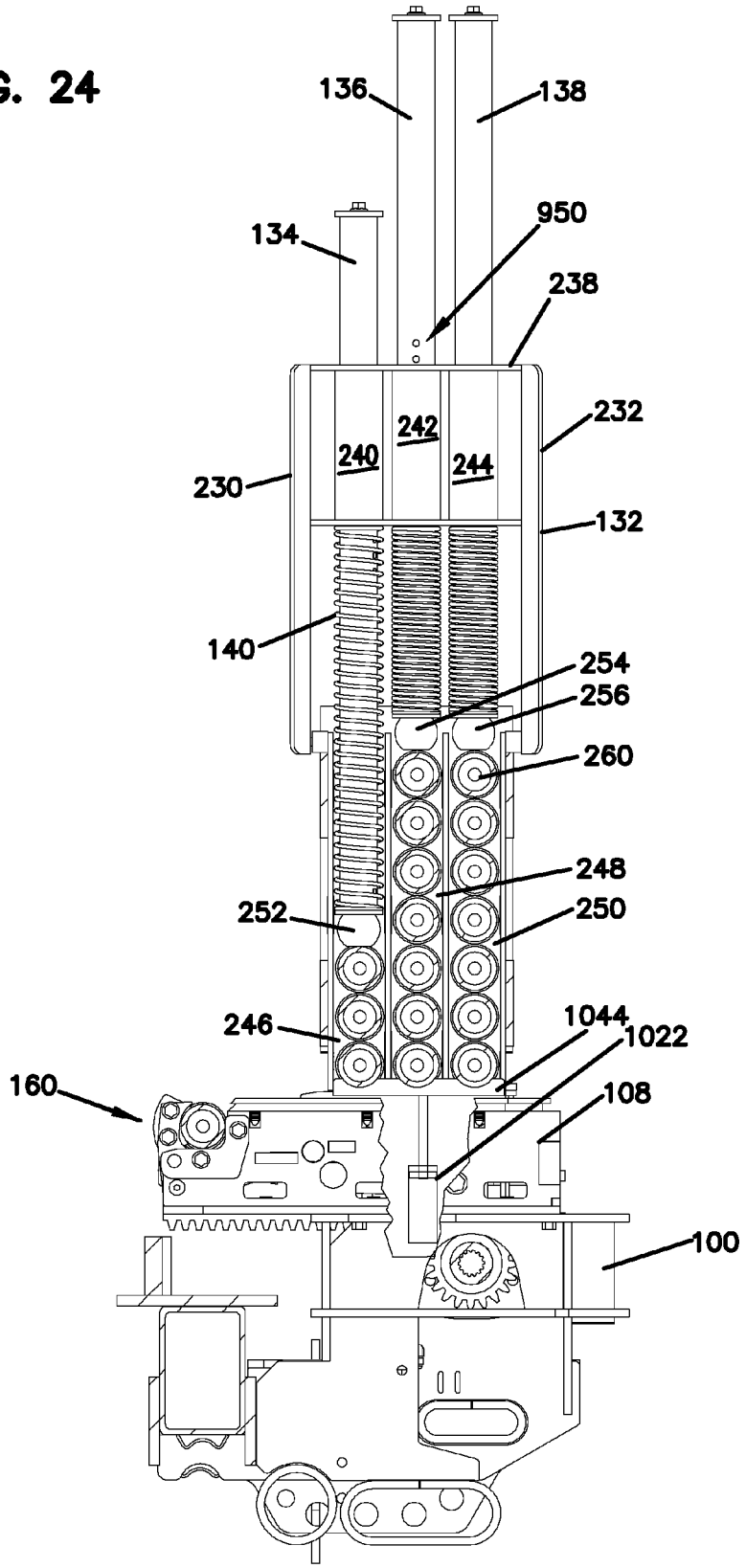
FIG. 24 is a cross-sectional view of the rod box and hold down assembly of FIG. 23.

Referring to FIGS. 23-24, the hold down assemblies 16, 17 of the depicted embodiment are described in greater detail. In the depicted embodiment, hold down assemblies 16 and 17 are substantially identical, therefore, only hold down assembly 16 will be described herein in detail.

In the depicted embodiment hold down assembly 16 includes a mount frame 132 including a first side member 230 and a second side member 232. The first side member 230 is attached to a first side 234 of the rod box 18, and the second side member 232 is attached to a second side 236 of the rod box 18. The side members are connected at a top end via a brace 238 that supports a plurality of push rod sleeves 240, 242, 244, which are configured to apply pressure to the drill rods in the rod box. The push rod sleeves 240, 242, 244 are aligned with rod box columns 246, 248, 250. Push rods 134, 136, 138 are received within the sleeves 240, 242, 244 and are biased in a direction towards the load arms 106, 108 by coiled springs 140 that are positioned over the push rods 134, 136, 138 and located between the sleeves 240, 242, 244 and push rod end members 252, 254, 256. In the depicted embodiment the push rod end members are spherical shaped with a flattened distal surface for engaging the rods 260 in the rod box 18. It should be appreciated that although the push rods of the depicted embodiments are spring loaded, many other biasing configurations are possible. For example, the push rods could be hydraulic actuated or air shock (see FIGS. 30-33) rather than, or in addition to, being spring actuated.

In the depicted embodiment, the rod box includes a plurality of columns for arranging drill rods therein. The hold down assembly includes push rods arranged to bias the drill rods in each column toward the load arms. In the depicted embodiment, two push rods are arranged to apply pressure to drill rods in each column. In the depicted embodiment the push rods are configured to move independent of each other. In the depicted embodiment each of the rods includes apertures 950 (see FIG. 24) that are configured to receive pins that are inserted therein to lock the push rod in a preloaded condition. When the pins are removed, they are free to move towards the rods in the rod box and apply pressure thereon.

Figure 30:
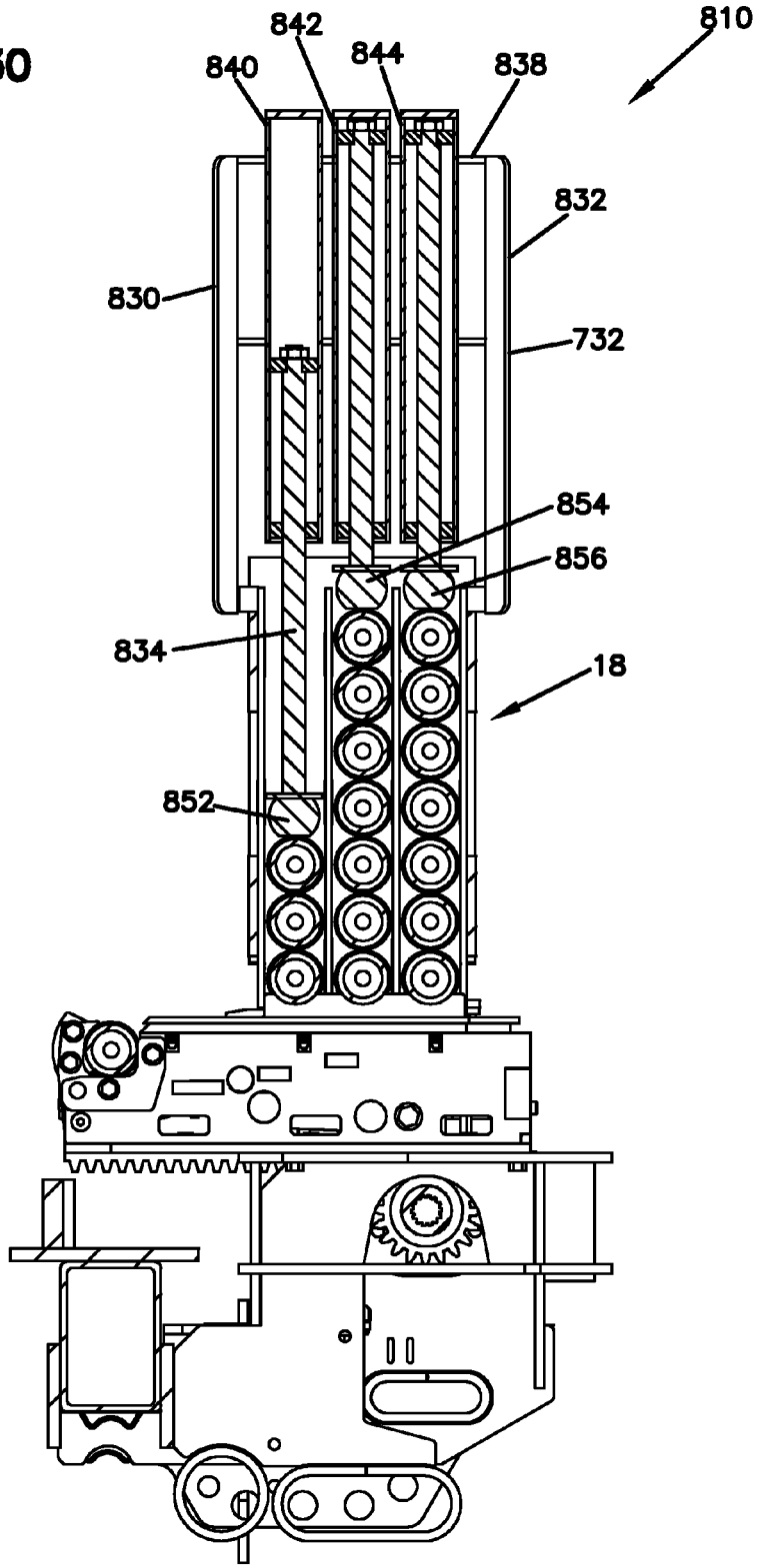
FIG. 30 is a cross-sectional view of a first alternative embodiment of the hold down assembly of FIG. 23.

Referring to FIG. 30, a first alternative embodiment of a hold down assembly is described. The hold down assembly 810 includes a mount frame 732 including a first side member 830 and a second side member 832. The first side member 830 is attached to a first side of the rod box 18, and the second side member 832 is attached to a second side of the rod box 18. The side members are connected at a top end via a brace 838 that supports a plurality of fluid cylinders (e.g., air cylinders, hydraulic cylinders, etc.) 840, 842, 844, which are configured to apply pressure to the drill rods in the rod box.

In the depicted embodiment, the fluid cylinders are aligned with columns of rods in the rod box 18 and are configured to move independent of each other. In the depicted embodiment portions of the cylinders that extend (e.g., the shaft 834) include distal located rod engaging ends 852, 854, 856. In the depicted embodiment, the fluid cylinders are configured to apply a generally constant force on the drill rods in the rod box. In embodiment wherein the fluid is hydraulic fluid the cylinder can be connected to a charge circuit such that the force applied by the cylinders on the rods is general constant and not dependent on the degree of extension of the cylinder.

Figure 31:
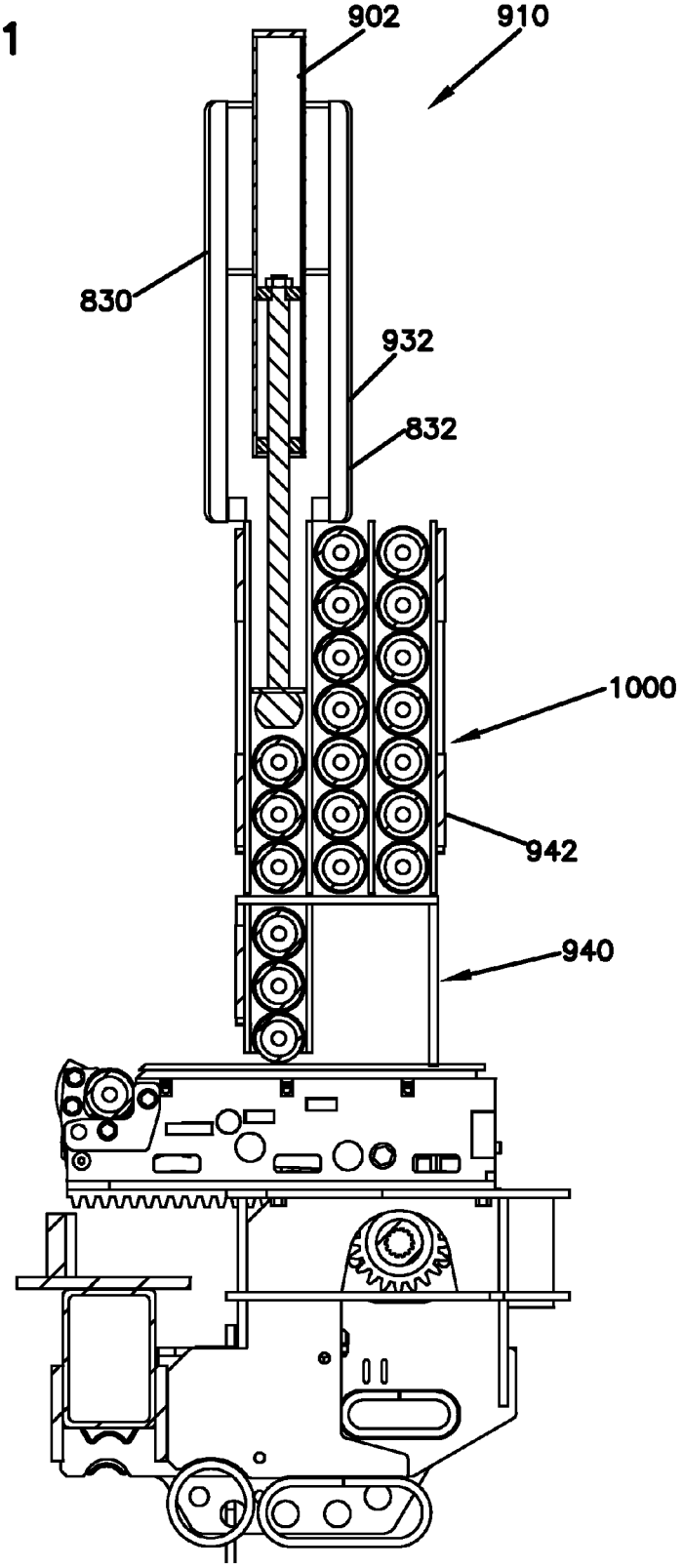
FIG. 31 is a cross-sectional view of a second alternative embodiment of the hold down assembly of FIG. 23 in a first position.
Figure 32:
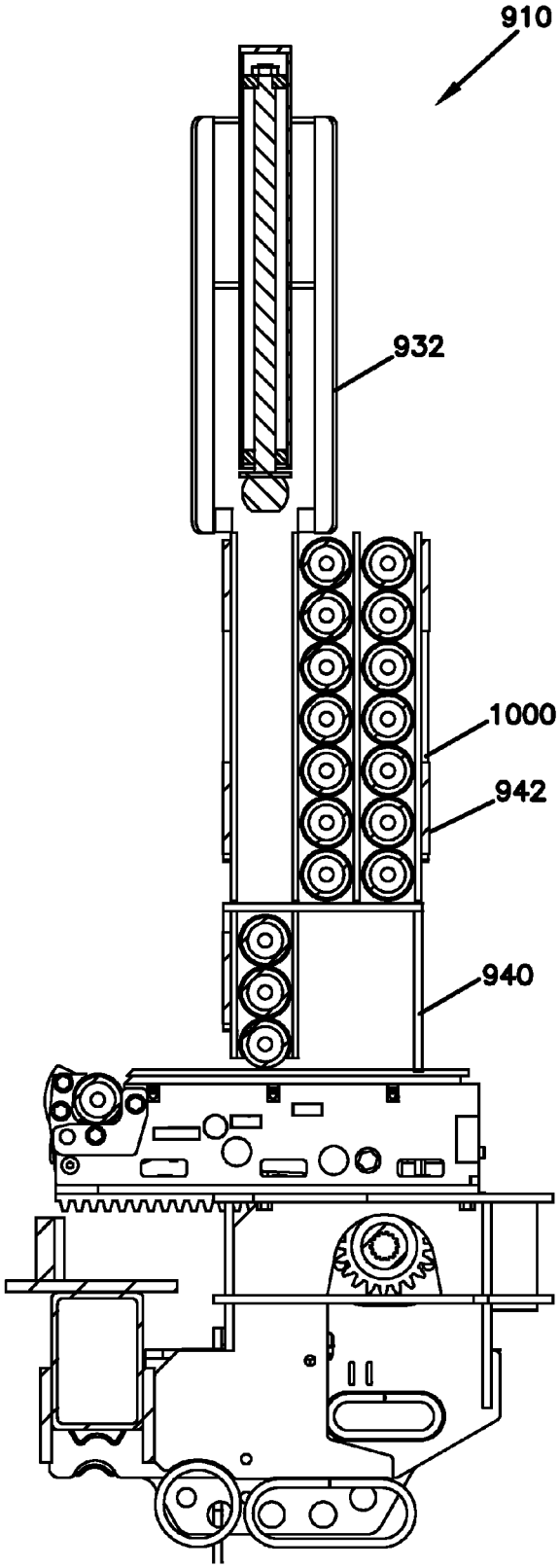
FIG. 32 is a cross-sectional view of the hold down assembly of FIG. 31 in a second position.
Figure 33:
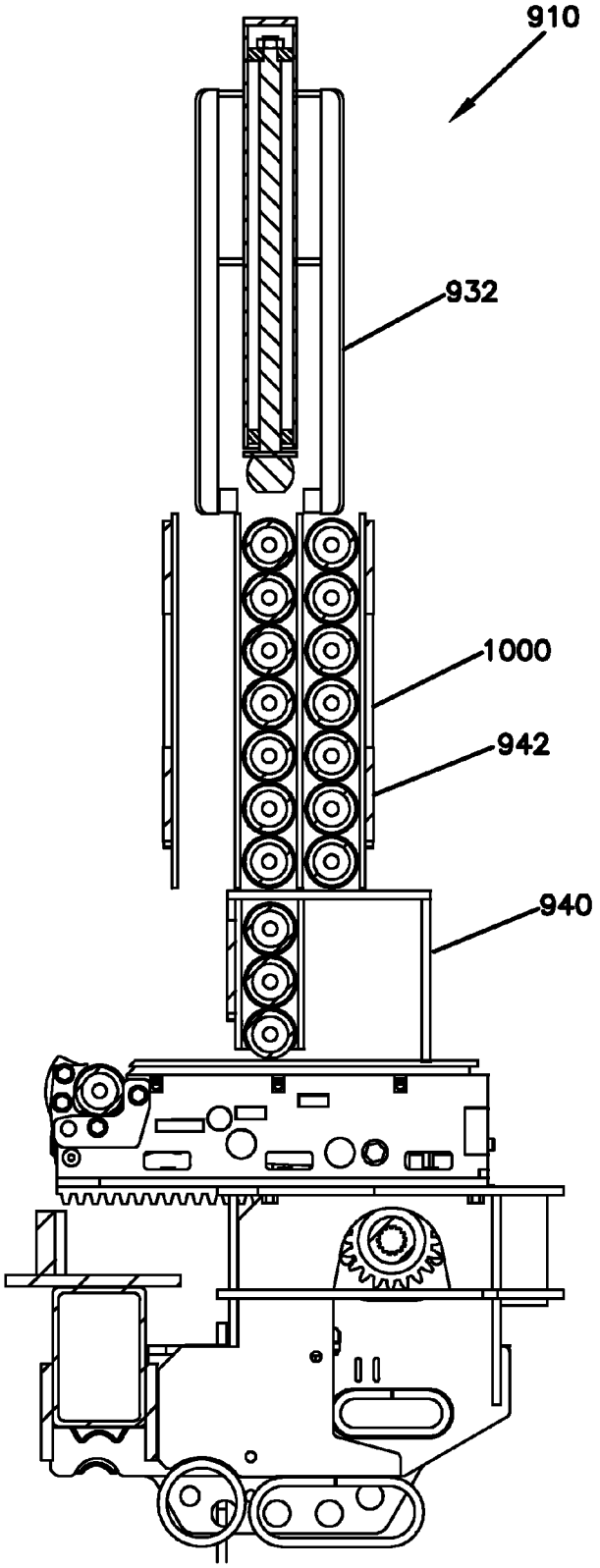
FIG. 33 is a cross-sectional view of the hold down assembly of FIG. 31 in a third position.

Referring to FIGS. 31-33, a second alternative embodiment of a hold down assembly is described. The hold down assembly 910 includes a mount frame 932 including a first side member 830 and a second side member 832. The hold down assembly 910 is mounted above the rod box such that it can move relative to a rod box 1000 and index itself over different columns of rods in the rod box 1000. In the depicted embodiment the rod box 1000 includes a lower assembly 940 positioned below a main body portion 942. The lower assembly 940 transitions rods from a single column in the main body portion 942 to the loader arms. The lower assembly 940 is configured to slide laterally relative to the main body portion 942 to block rods in all but one column to allow discharge of rods from one column of the rod box at a time. In the depicted embodiment the lower assembly 940 serves as a bottom of the main body portion 942, which allows for selectively discharging rods from the columns in the rod box.

FIGS. 31 and 32 show the hold down assembly 910 positioned over the left most column of rods in the rod box 1000, and FIG. 33 shows the hold down assembly 910 moved over an adjacent column in the rod box 1000. In the depicted embodiment the hold down assembly could include a single actuating unit 902 arranged about half way between the end of the rods. Alternatively, the hold down assembly could include multiple actuating units (e.g., one unit configured to apply force to an up hole end of the drill rod and one unit configured to apply force to the down hole end of the drill rods). It should be appreciated that many other alternative configurations are also possible.

Figure 25:
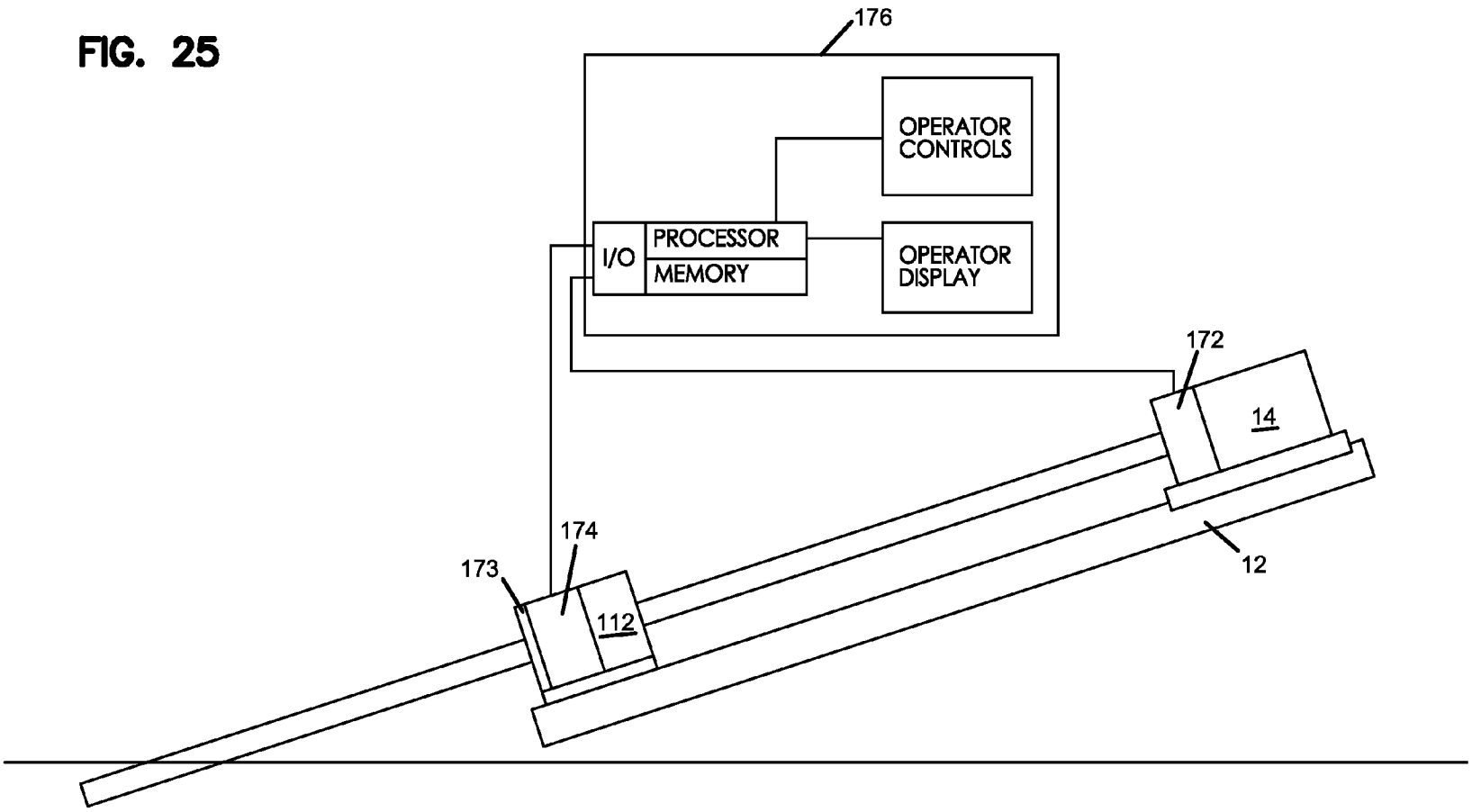
FIG. 25 is a diagrammatic illustration of components of the vise lock and release control system.
Figure 26:
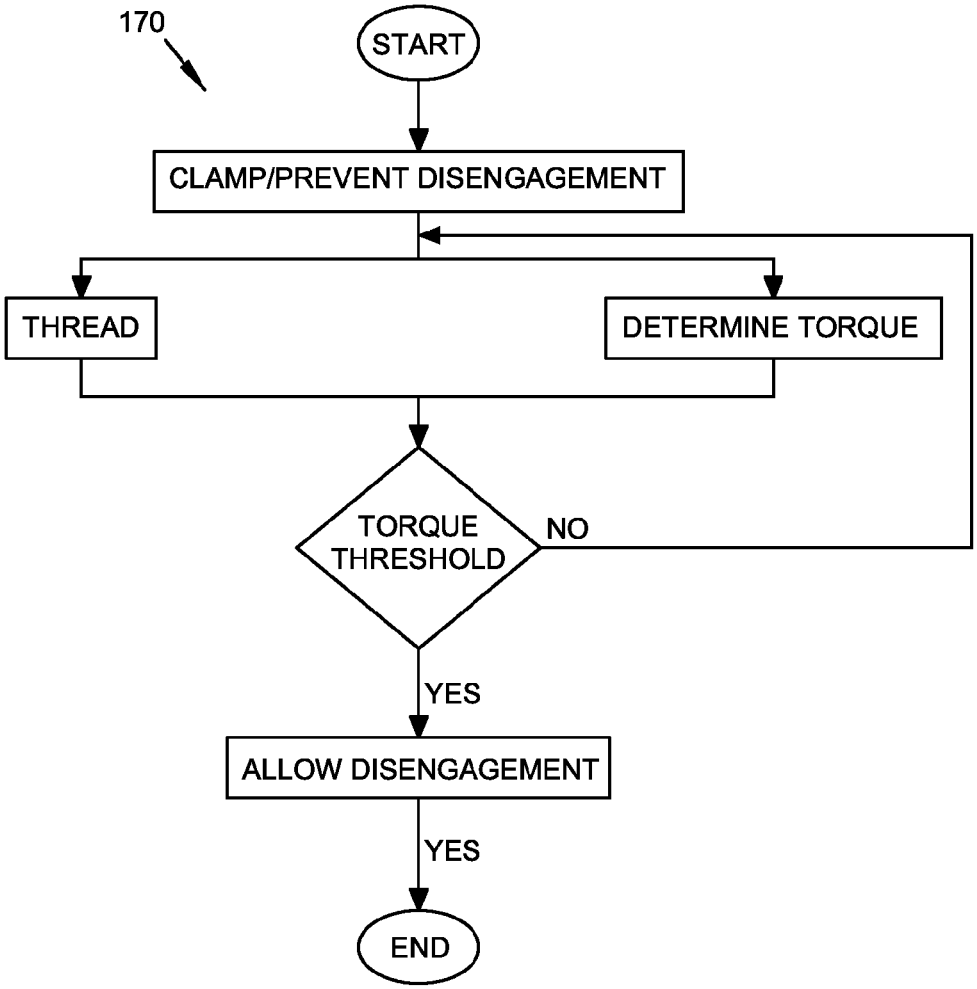
FIG. 26 is a flow chart of the vise control system.

Referring to FIGS. 25 and 26, a vise control system 170 of the drilling machine 10 of the depicted embodiment is described. In the depicted embodiment, the vise control system 170 is configured to ensure that the drill rods are properly connected to the drill string. In the depicted embodiment the vise control system 170 includes a torque sensor 172 for sensing the torque between the down hole end of a drill rod 201 and the up hole end of the drill string, a vise lock 174 for controlling the sequence upon which the lower vise 114 can be released (e.g., unclamped), and an on-board computer 176 that is operably connected to the torque sensor 172 and the vise lock 174. The torque sensor can be configured to estimate the torque between a drill rod 201 and a drill string. In the depicted embodiment, the lower vise 114 clamps onto the up hole end of the drill string and the drive unit 104 rotates the drill rod being added to the drill string and threads it to the uphold end of the string. The torque sensor is configured to measure the torque applied between the rod drive unit and a drill rod 201.

In the depicted embodiment, the vise control system 170 is configured to determine when the torque between the drill string and the drill rod 201 is sufficient. If the determined torque between the drill string and drill rod 201 is insufficient, the control system can alert the operator so that the operator can manually apply more torque to the drill rod 201 via the drive unit 104. Alternatively, the control system can automatically direct the drilling machine 10 to apply more torque to the drill rod 201 until the drill rod 201 is sufficiently torqued to the drill string. The level of torque that is sufficient (also referred to herein as the threshold torque) can be user inputted or automatically determined (e.g., determined based on the size of the machine or the type of drill rods used by the machine).

In the depicted embodiment, the vise control system 170 is further configured to prevent the lower vise 114 from releasing the drill string until the system determines that the torque between the drill rod and drill string is sufficient. In the depicted embodiment, the system prevents the release of the lower vise 114 by deactivating the vise release user control (e.g., release lever/button) until the desired torque level is detected. This functionality helps avoid losing the drill string in the hole due to poor connections between the drill string and the drill rod. In the depicted embodiment the user can override the auto lockout functionality via a reset procedure (e.g., activating a reset button that reactivates the vise control even though the detected torque is less than the threshold torque). The control system can also be further configured to automatically release of the lower vise when the rod drive unit applies a predetermined level of torque to the drill rod.

In the depicted embodiment, the control system 170 is configured to determine the torque simultaneously with the threading of the drill rod to the drill string. In the depicted embodiment, the torque sensor is located at the drive unit 104. The control system 170 is configured to determine that the threshold torque is reached when the sensed torque applied to the drill rod by the drive unit 104 exceeds a certain level for a set time interval. In the depicted embodiment, the torque level between the up hole end of the drill string and the down hole end of the drill rod is estimated based on the sensed torque applied by the drive unit 104 to the drill rod. The sensed torque applied to the up hole end is based on a quantity that is correlated with torque and/or a direct torque measurement on the drive shaft of the drive unit 104. The quantity that is correlated to the torque at the connection between the up hole end of the drill string and the down hole end of the drill rod can be, for example, the hydraulic pressure in a drill rod drive system, the deceleration in the deceleration of the drill rod threading rotation, or any other quantity that is related or otherwise indicative of whether the connection is between the down hole end of the drill rod and the up hole end of the drill string is secure.

In the depicted embodiment the vise control sequence can include the following steps: a clamping step including clamping an up hole end of a drill string in a vise; a threading step including threading a down hole end of a drill rod to the up hole end of the drill string; a determining step including determining a torque at the connection between the up hole end of the drill string and the down hole end of the drill rod; and an enabling step including enabling disengagement of the vise from the up hole end of the drill string upon determining the torque exceeds a threshold torque. As discussed above, the determining step can occur simultaneously with the threading step. The determining step may entail threading for a set time interval while the torque at the connection between the up hole end of the drill string and the down hole end of the drill rod is above a threshold level. The determining step can include measuring torque applied to the up hole end of the rod. The step of measuring the torque applied can include measuring a quantity that is correlated to the torque at the connection between the up hole end of the drill string and the down hole end of the drill rod. The quantity that is correlated to the torque at the connection between the up hole end of the drill string and the down hole end of the drill rod can be the hydraulic pressure of a drill rod drive system. The enabling step can include reactivating operator control of the vise (e.g., reactivating a manual vise release button).

In the depicted embodiment the up hole end of the drill rod is configured to thread to the drive unit 104 before the drill rod is threaded to the up hole end of the drill string. The threading step is accomplished such that the control system 170 does not erroneously conclude that the up hole end of the drill string and the drill rod are securely connected and enable disengagement of the vise. In the depicted embodiment, gripping fingers of the loader arms secure the drill rod while the drive unit 104 is threaded thereto. The gripping fingers are configured to allow the drill rod to rotate while the rod is still in contact with the loading arms after the drill rod is connected to the drive unit 104 to a torque level that is sufficient to secure the drill rod to the drive unit 104, but less than the threshold torque. Since the drill rods will rotate within the loading arm once a torque level is reached, which is lower than the threshold torque level, the control system 170 will not erroneously conclude that the up hole end of the drill string and the new drill rod are secured as a result of the step of connecting the drill rod to the drive unit 104.

In the depicted embodiment the above-described control system 170 can be configured to automatically activate and deactivate based on the angle of the drill string. In low angle operations (e.g., horizontal drilling operations of less than 45 degrees) it is unlikely that the drill string will be lost down hole even if it is disconnected from the drilling machine. In such low angle operations the system can be configured to not prevent the lower vise from releasing based on the operator's controls. On the other hand, in high angle operations (e.g., geothermal drilling at angles for greater than 45 degrees) it is likely that the drill string will move down hole on its own if it is disconnected from the drilling machine. In such high angle operations, the control system 170 is automatically activated. In the depicted embodiment the system includes an indicator light that alerts the operator when the auto-lock system is activated. In the depicted embodiment, the control system 170 includes an inclinometer that measures the angle of the rack 100 to trigger the automatic activation. As discussed above, the control system can also be manually activated and deactivated by the user. It should be appreciated that many other configurations are also possible.

Figure 27:
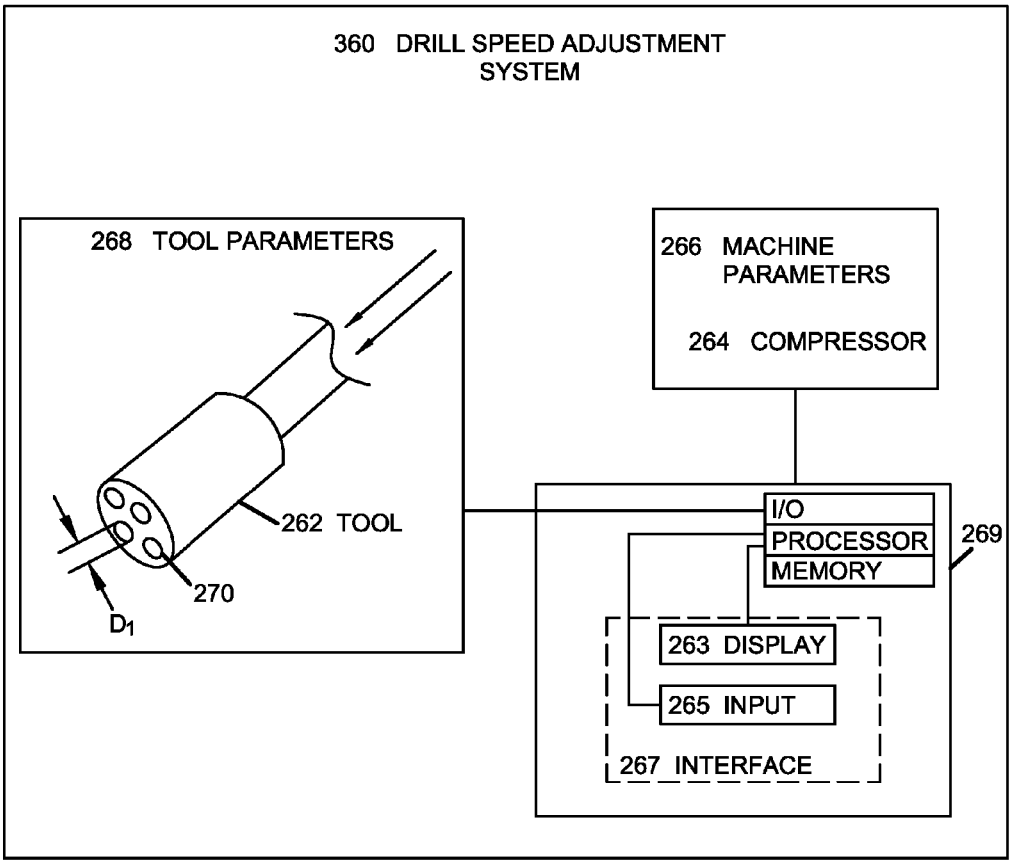
FIG. 27 is a diagrammatic illustration of a rod rotation speed control system.

Referring to FIG. 27, a drilling speed adjustment system 360 of the drilling machine of the depicted embodiment is described. The drill speed adjustment system 360 is configured to determine the preferred rotational speed of the drill string corresponding to various drilling applications. Desirable rotational speeds for drilling vary from application to application and can depend on a number of factors including tool parameters 268 and machine parameters 266. The system can include a look up table for rotation speed that correlated variety of tool parameters 268 and machine parameters 266.

Example tool parameters can include the type of the cutting tool 262 (e.g., air hammer, non-hammering bits, etc.), the size of the cutting tool, the geometry of cutting face (e.g., the arrangement of cutting buttons 270, the shapes and sizes of the cutting buttons 270). Example machine parameters can include the machine type, the drive unit type, the power of the machine, the orientation of the machine (e.g., the angle of the rack, air pressure in the drill string, the specification of an air compressor 264, etc.). It should be appreciated that the machine parameters and tool parameters can be sensed, hardwired, or user imputed to an on-board computer 269 via a user interface, which could be the same computer that controls other functions (e.g., on-board vise control computer 176).

In the depicted embodiment, the drill speed adjustment system 360 determines a rotational speed or a range of rotational speeds based on the user defined or sensed inputs such as those described above. The drill speed adjustment system 360 is further configured to use the determined rotational speed to set a default rotational drill speed and/or provide the operator a recommended rotational speed via a display 263. For example, in the depicted embodiment the drill speed adjustment system 360 can determine a rotation speed for an application in which an air hammer is used. The drill speed adjustment system 360 can determine the rotation speed of the drill string that is correlated to rotating the distance of a half a diameter of a cutting button per percussion.

The drill speed adjustment system 360 can determine the speed based on the cutting tool name that corresponds to a specific button size and layout, the air hammer name that corresponds to a certain frequency of percussion at a particular air pressure, and the air pressure can be estimated based on the machine type or air compressor type. Alternatively, the drill adjustment system 360 can determine the speed based on generic data. For example, the rotational speed can be determined based on the geometry and layout of the button on the cutting tool, the class of air hammer, and the sensed air pressure in the drill string.

The determined speed can be further incrementally adjusted based on sensed data during operations such as the actual frequency of percussion and the types of material that are being drilled into. In the depicted embodiment, the rotational speed of the drill string can be monitored and modified during drilling operations. In the depicted embodiment the drill machine includes a user interface 267 with an input device 265 (dial, pedal, knob, lever, touch screen, etc.) that the user can use to incrementally adjust the speed of the drill string as the drill string is rotating. In the depicted embodiment, the drill speed adjustment assembly is configured to optimize drill speed by adjusting the rotational speed (up or down) to maximize the speed that the drill rods are driven into the ground. For example, the drill speed adjustment assembly of the depicted embodiment is configured to automatically incrementally increase the rotational speed of a drill string so long as the drilling speed increases and is configured to automatically incrementally decrease the rotational speed of a drill string so long as the drilling speed increases. The automatic incremental increase and decrease in the rotational speed of a drill string can be configured to continue until a maximum speed of a drive unit relative to a rack is reached.

Figure 28:
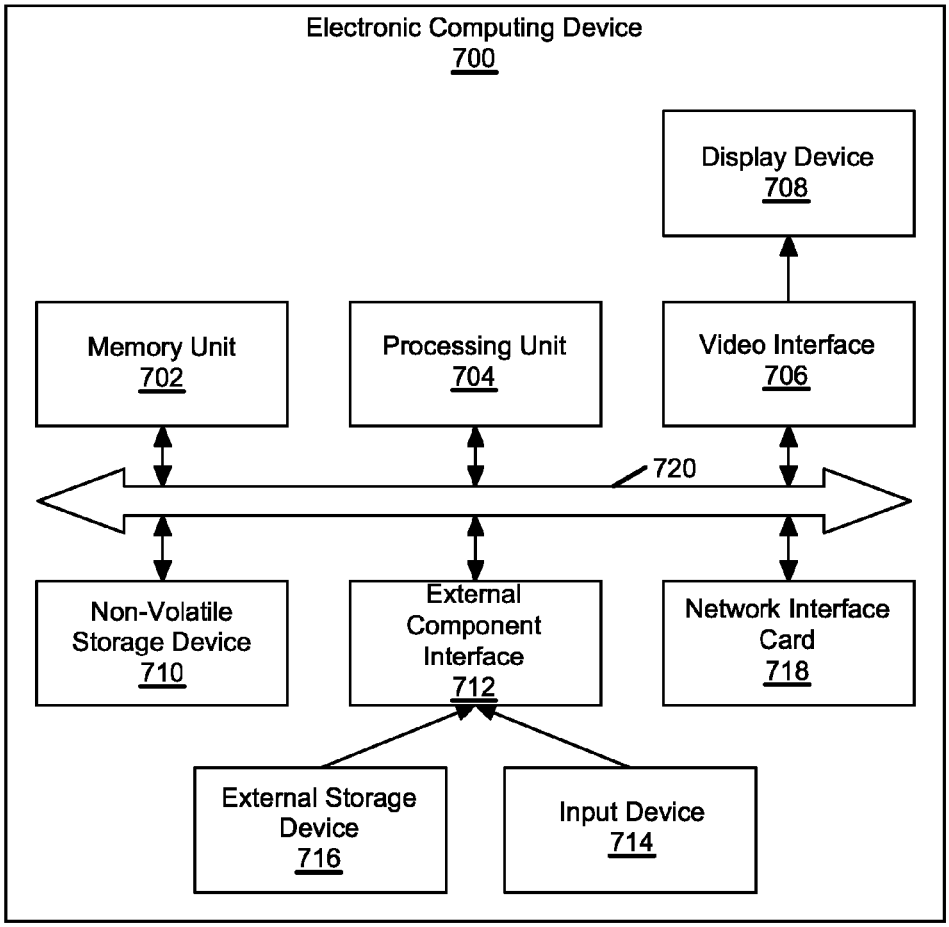
FIG. 28 is a block diagram illustrating example physical components of an electronic computing device useable to implement the various methods and systems described herein.

Referring to FIG. 28 the physical components of an electronic computing device (e.g., 176 and 296) is described in greater detail. FIG. 28 is a block diagram illustrating example physical components of an electronic computing device 700, which can be used to execute the various operations described above. A computing device, such as electronic computing device 700, typically includes at least some form of computer-readable media. Computer readable media can be any available media that can be accessed by the electronic computing device 700. By way of example, and not limitation, computer-readable media might comprise computer storage media and communication media.

As illustrated in the example of FIG. 28, electronic computing device 700 comprises a memory unit 702. Memory unit 702 is a computer-readable data storage medium capable of storing data and/or instructions. Memory unit 702 may be a variety of different types of computer-readable storage media including, but not limited to, dynamic random access memory (DRAM), double data rate synchronous dynamic random access memory (DDR SDRAM), reduced latency DRAM, DDR2 SDRAM, DDR3 SDRAM, Rambus RAM, or other types of computer-readable storage media.

In addition, electronic computing device 700 comprises a processing unit 704. As mentioned above, a processing unit is a set of one or more physical electronic integrated circuits that are capable of executing instructions. In a first example, processing unit 704 may execute software instructions that cause electronic computing device 700 to provide specific functionality. In this first example, processing unit 704 may be implemented as one or more processing cores and/or as one or more separate microprocessors. For instance, in this first example, processing unit 704 may be implemented as one or more Intel Core 2 microprocessors. Processing unit 704 may be capable of executing instructions in an instruction set, such as the x86 instruction set, the POWER instruction set, a RISC instruction set, the SPARC instruction set, the IA-64 instruction set, the MIPS instruction set, or another instruction set. In a second example, processing unit 704 may be implemented as an ASIC that provides specific functionality. In a third example, processing unit 704 may provide specific functionality by using an ASIC and by executing software instructions.

Electronic computing device 700 also comprises a video interface 706. Video interface 706 enables electronic computing device 700 to output video information to a display device 708. Display device 708 may be a variety of different types of display devices. For instance, display device 708 may be a cathode-ray tube display, an LCD display panel, a plasma screen display panel, a touch-sensitive display panel, an LED array, or another type of display device.

In addition, electronic computing device 700 includes a non-volatile storage device 710. Non-volatile storage device 710 is a computer-readable data storage medium that is capable of storing data and/or instructions. Non-volatile storage device 710 may be a variety of different types of non-volatile storage devices. For example, non-volatile storage device 710 may be one or more hard disk drives, magnetic tape drives, CD-ROM drives, DVD-ROM drives, Blu-Ray disc drives, or other types of non-volatile storage devices.

Electronic computing device 700 also includes an external component interface 712 that enables electronic computing device 700 to communicate with external components. As illustrated in the example of FIG. 7, external component interface 712 enables electronic computing device 700 to communicate with an input device 714 and an external storage device 716. In one implementation of electronic computing device 700, external component interface 712 is a Universal Serial Bus (USB) interface. In other implementations of electronic computing device 700, electronic computing device 700 may include another type of interface that enables electronic computing device 700 to communicate with input devices and/or output devices. For instance, electronic computing device 700 may include a PS/2 interface. Input device 714 may be a variety of different types of devices including, but not limited to, keyboards, mice, trackballs, stylus input devices, touch pads, touch-sensitive display screens, or other types of input devices. External storage device 716 may be a variety of different types of computer-readable data storage media including magnetic tape, flash memory modules, magnetic disk drives, optical disc drives, and other computer-readable data storage media.

In the context of the electronic computing device 700, computer storage media includes volatile and nonvolatile, removable and non-removable media implemented in any method or technology for storage of information such as computer readable instructions, data structures, program modules or other data. Computer storage media includes, but is not limited to, various memory technologies listed above regarding memory unit 702, non-volatile storage device 710, or external storage device 716, as well as other RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and that can be accessed by the electronic computing device 700.

The above specification, examples, and data provide a complete description of the manufacture and use of the composition of the invention. Since many embodiments of the invention can be made without departing from the spirit and scope of the invention, the invention resides in the claims hereinafter appended.

We claim:

1. A ground drilling machine comprising:

a rack including an up hole end and a down hole end;

a rod drive unit movably mounted on the rack, the rod drive unit configured to thread a drill rod to a drill string;

a rod loader arm configured to move a drill rod from a rod box into alignment with the rod drive unit and secure the drill rod as it is threaded to the drive unit;

a vise assembly connected to the rack at a down hole end, the vise assembly including a lower vise that is configured when activated to support the weight of a drill string and prevent rotation of the drill string; and a control system is configured to automatically deactivate a user control vise release to prevent release of the lower vise until the rod drive unit applies a predetermined level of torque to the drill rod; and wherein the control system is configured to determine whether the predetermined level of torque is applied based on applying a certain level of torque to the drill rod by the drive unit for a set time interval.

2. The ground drilling machine of claim 1, wherein the vise assembly includes an upper vise that is configured to rotate relative to the lower vise.

3. The ground drilling machine of claim 1, further comprising a torque sensor configured to estimate the torque between a drill rod and a drill string.

4. The ground drilling machine of claim 3, wherein the torque sensor is configured to measure the torque applied between the rod drive unit and a drill rod.

5. The ground drilling machine of claim 1, wherein the control system is configured to selectively disable or enable the user controlled vise release based on the orientation of the rack.

6. The ground drilling machine of claim 1, wherein the user controlled vise release is a vise release button.

7. The ground drilling machine of claim 1, wherein the control system is further configured to automatically release of the lower vise when the rod drive unit applies a predetermined level of torque to the drill rod.

8. The ground drilling machine of claim 1, wherein the control system determines that a predetermined level of torque is applied to the drill rod based on measuring a quantity that is correlated to the torque at the connection between the up hole end of the drill string and the down hole end of the drill rod.

9. The ground drilling machine of claim 8, wherein the quantity that is correlated to the torque at the connection between the up hole end of the drill string and the down hole end of the drill rod is the hydraulic pressure in a drill rod drive system.

10. The ground drilling machine of claim 8, wherein the quantity that is correlated to the torque at the connection between the up hole end of the drill string and the down hole end of the drill rod is the deceleration in the rotational speed of the drill rod drive system.

11. A method of connecting a rod to a drill string comprising:

a clamping step including clamping an up hole end of a drill string in a vise, wherein the clamping step limits rotation movement of the drill string and lateral motion of the drill string and disables disengagement of the vise from the up hole end of the drill string;

a loading step including using a loader arm to move a drill rod into alignment with a drive unit;

a first threading step including threading the drive unit to the drill rod while the drill rod is secured in the loader arm;

a second threading step including threading a down hole end of a drill rod to the up hole end of the drill string by rotating the drill rod with the drive unit;

a determining step including determining a torque at the connection between the up hole end of the drill string and the down hole end of the drill rod; and an enabling step including enabling disengagement of the vise from the up hole end of the drill string upon determining that the determined torque exceeds a threshold torque;

wherein the determining step occurs simultaneously with the threading step; and wherein the determining step includes threading for a set time interval while the torque applied to the drill rod is above a threshold level.

12. The method of claim 11, wherein the first threading step includes rotating the drill rod with the drive unit while the drill rod is secured by the loader arm with a torque that is less than the threshold torque.

13. The method of claim 11, wherein the determining step includes measuring a quantity that is correlated to the torque at the connection between the up hole end of the drill string and the down hole end of the drill rod.

14. The method of claim 13, wherein the quantity that is correlated to the torque at the connection between the up hole end of the drill string and the down hole end of the drill rod is the deceleration of the drill rod threading rotation.

15. The method of claim 13, wherein the quantity that is correlated to the torque at the connection between the up hole end of the drill string and the down hole end of the drill rod is the hydraulic pressure in a drill rod drive system.

16. The method of claim 11, wherein the enabling step includes reactivating a vise release operator control device.

17. The method of claim 11, wherein operator control of the vise can be enabled even when the torque does not exceed the threshold torque via a manual override sequence.

18. A ground drilling machine comprising:

a rack including an up hole end and a down hole end;

a rod drive unit movably mounted on the rack, the rod drive unit configured to thread a drill rod to a drill string;

a rod loader arm configured to move a drill rod from a rod box into alignment with the rod drive unit and secure the drill rod as it is threaded to the drive unit;

a vise assembly connected to the rack at a down hole end, the vise assembly including a lower vise that is configured when activated to support the weight of a drill string and prevent rotation of the drill string;

a control system is configured to automatically deactivate a user control vise release to prevent release of the lower vise until the rod drive unit applies a predetermined level of torque to the drill rod;

wherein the control system determines that a predetermined level of torque is applied to the drill rod based on measuring a quantity that is correlated to the torque at the connection between the up hole end of the drill string and the down hole end of the drill rod; and wherein the quantity that is correlated to the torque at the connection between the up hole end of the drill string and the down hole end of the drill rod is the deceleration in the rotational speed of the drill rod drive system.

19. A method of connecting a rod to a drill string comprising:

a clamping step including clamping an up hole end of a drill string in a vise, wherein the clamping step limits rotation movement of the drill string and lateral motion of the drill string and disables disengagement of the vise from the up hole end of the drill string;

a loading step including using a loader arm to move a drill rod into alignment with a drive unit;

a first threading step including threading the drive unit to the drill rod while the drill rod is secured in the loader arm;

a second threading step including threading a down hole end of a drill rod to the up hole end of the drill string by rotating the drill rod with the drive unit;

a determining step including determining a torque at the connection between the up hole end of the drill string and the down hole end of the drill rod; and an enabling step including enabling disengagement of the vise from the up hole end of the drill string upon determining that the determined torque exceeds a threshold torque;

wherein the determining step includes measuring a quantity that is correlated to the torque at the connection between the up hole end of the drill string and the down hole end of the drill rod; and wherein the quantity that is correlated to the torque at the connection between the up hole end of the drill string and the down hole end of the drill rod is the deceleration of the drill rod threading rotation.

* * * * *